US007396163B2

(12) United States Patent
McGregor

(10) Patent No.: US 7,396,163 B2
(45) Date of Patent: Jul. 8, 2008

(54) PAPER AND PLASTIC BAGS FLEXIBLE PACKAGES AND OTHER CONTAINERS WITH RE-CLOSABLE DEVICE AND METHOD OF MAKING THE SAME

(76) Inventor: James Ray McGregor, 23175 France Cir., Lakeville, MN (US) 55044

( * ) Notice: Subject to any disclaimer, the term of this patent is extended or adjusted under 35 U.S.C. 154(b) by 807 days.

(21) Appl. No.: 10/319,185

(22) Filed: Dec. 14, 2002

(65) Prior Publication Data

US 2004/0114838 A1 Jun. 17, 2004

(51) Int. Cl.
*B65D 33/00* (2006.01)
*B65D 33/14* (2006.01)
*B65D 33/16* (2006.01)

(52) U.S. Cl. ..... 383/204; 383/5; 383/61.2; 383/63; 383/66

(58) Field of Classification Search ..... 383/66, 383/61.2, 63, 203–204, 5, 906
See application file for complete search history.

(56) References Cited

U.S. PATENT DOCUMENTS 4,877,336 A * 10/1989 Peppiatt ..... 383/8
5,080,497 A * 1/1992 Peppiatt ..... 383/21
6,164,826 A * 12/2000 Petkovsek ..... 383/210.1
6,213,641 B1 * 4/2001 Price ..... 383/63
6,360,513 B1 * 3/2002 Strand et al. ..... 53/412
6,481,183 B1 * 11/2002 Schmidt ..... 53/412

FOREIGN PATENT DOCUMENTS

JP 3-240650 * 10/1991
JP 3-240651 * 10/1991

* cited by examiner

*Primary Examiner*—Jes F Pascua
(74) *Attorney, Agent, or Firm*—Herman H Bains

(57) ABSTRACT

A package or bag is provided with an easy open re-closable device for allowing ready access to the contents of the bag. The closure device is applied longitudinally in a vertical orientation in plastic bags but the closure device is spaced from the ends. In a layer paper bag, while the position of the closure device is preferably longitudinal, the closure device may have any orientation including a diagonal position. The closure device is incorporated in the fins of a fin bag and the closure devices extends longitudinally of the bag in a vertical direction. The process or making a multi layer paper material with a closure device incorporated therein is carried out in a continuous operation. The process of making zip-fin plastic bag or film containing the fins and closure are performed in a continuous operation.

18 Claims, 12 Drawing Sheets

250
256
252
253
257
249
251
254
255
31
32
257a
258
259
261
262
263
265
266
267
268
269
270
271
272
248

PAPER AND PLASTIC BAGS FLEXIBLE PACKAGES AND OTHER CONTAINERS WITH RE-CLOSABLE DEVICE AND METHOD OF MAKING THE SAME

FIELD OF THE INVENTION

This invention pertains generally to easy-open and resealable closures for bags, flexible packages and other containers and specifically to easy-open and/or resealable closure mechanisms oriented longitudinally with the height of the bag, flexible package or containers along with the processes for producing (and filling) closures and packages with closures.

BACKGROUND OF THE INVENTION

Present technology for easy-open resealable closures is focused primarily across the top of the bag or flexible package. Applicant claims benefit of the filing date of applicant's co-pending provisional application, Application No, 60/340,581 filed Dec. 14, 2001. The transverse positioning of the closure in the same opening of the package that is used to fill the package creates numerous limitations and problems. For example, providing a transverse closure device at the top of the package requires additional headspace in the top of the package that increases package costs and package size. This additional headspace requirement also increases shipping volume. Further, problems of efficient utilization of material handling methods of distribution ranging from pallet loading to-shelf presentation are encountered with packages having large headspace typically ranging from packages of less than 1 kg. up to packages of 25 kg.

In conventional technology, access to the contents of a package is from the top of the package or bag. Access to the bag contents in this manner requires a consumer to reach further into the package as the contents are removed, thus making the retrieval of the contents more difficult as the package is emptied over time.

In the present invention a resealable closure device for packages is provided and is arranged longitudinally of the package. Certain prior art devices have attempted to provide vertically oriented (longitudinally arranged) openings or pouring spouts. For example, U.S. Pat. No. 6,206,571 and Pat. Pub. No. U.S. 2001/0010737 to Olin, FIGS. 18 and 19, discloses a vertically or longitudinally arranged re-closable opening in a bag but this re-closable access opening extends across the transverse seal at the upper edge. In order to provide a sealed package, Olin must seal across the closure device which typically crushes the re-closable feature and increases the likelihood of channel leakers. Channel leakers compromises the sealed interior of the package and results in rejected packages. Olin is directed to disclosure of making plastic cereal box liners or bags only on a form fill seal machine and is not intended for heavier bags or shipping sacks. Further, Olin is concerned only with pouring contents from the bag and is not concerned with scooping.

U.S. Pat. No. 6,177,172 to Yeager discloses a package and process of making the bag in which a zipper is pre-applied to film and preferably positioned transversely to the film's longitudinal formation axis. The closure is described as transversely oriented. The methods disclosed have particular utility in producing a bacon package but the access opening and closure device are located in one plane (single panel) and extends transversely of the package. Access openings located in a single plane are difficult to open.

U.S. Pat. No. 6,327,837 to Van Erden discloses method of pre-applying slide zipper assemblies to film in both transverse and longitudinal orientation. The method produces a tube bag or package having a transverse seal along the top of the package. Van Erden discloses that the zipper closure forms the top of the bag.

U.S. Pat. Nos. 6,416,221 and 6,213,641 to Price disclose a stand-up pouch with top and bottom gussets with a closure located at the top of the bag. It is emphasized in the Price patents that this location of the opening for closure (the same opening through which the bag is filled) aids in the filling of the bag. Applicant believes the Price package creates a likelihood of channel leakers.

Applicant's novel bags or packages also include a uniquely located tamper evident element. U.S. Pat. No. Application Pub. U.S. 2002/0094137 to Schneider discloses a package having a tamper evident element. However, the Schneider publication is directed to a slider type closure for a transversely extending opening for plastic bags.

U.S. Pat. Nos. 6,317,939 and 6,183,134 to Malin disclose bags having high internal force resistant peel sealable zippers. However, the access opening for these bags closed by the resistant peel sealable zippers are the same openings through which the bags are filled.

The present invention overcomes these problems listed above and provides many additional advantages over conventional packages.

SUMMARY OF THE INVENTION

An object of this invention is to provide novel package having a resealable closure and process for making such packages.

A more specific object of this invention is to provide novel package having a longitudinally (vertically) oriented access opening and a sealable closure which reduces headspace in the top of the package thereby decreasing package cost and package size. By reducing headspace in these novel packages with resealable closures a potentially tightly filled package that utilizes less packaging material may be realized while providing re-close feature that is both pourable and scoopable. This advantage produces the benefit of a better presentation of the package to the consumer and more efficient utilization of material handling methods of distribution ranging from pallet loading to shelf presentation for packages typically ranging from less than 1 kg up to 25 kg. The access opening and closure may be located longitudinally anywhere on the package.

Another object of this invention is to provide a resealable closure for gusseted flexible packages and method of making the same wherein a tamper evident feature may be incorporated in such packages typically ranging in size from 1 kg to 25 kg. An internal tamper evident feature incorporated in such packages is designed to withstand the internal forces generated against the closure when utilized on larger weight flexible packages. It is believed that this method is superior to the existing technology for easy open re-close systems and associated tamper evident systems for heavier weight flexible packages. This tamper evident feature also increases the resistance of a filled package panels to bursting (shear) when the package is inadvertently dropped.

Another object of the invention is to provide a easy-open re-close feature and a tamper evident feature that is positioned such that package is not filled through the same access opening that includes the re-close and tamper evident features. This is superior to conventional methods that generally fill through the same opening that the re-close and tamper evident are located. It provides the ability to tightly fill the package and use less packaging materials which reduces the head-space requirements for sealing the package. It also enables the re-close and tamper evident to be produced with the package materials whether pre-made packages or form fill seal films with pre-applied re-close and tamper evident features, both of which improves productivity and yield.

Another object of this invention is to provide a re-closable access opening internal to a corner fin seal of a gusseted plastic bag thereby creating both a natural pour spout and a scoopable opening for a consumer. By orienting this longitudinal easy-open re-closable access opening so that it curves around the natural top of a bag, a natural opening is created to access the contents of the package. In one embodiment, this same longitudinal closure includes a perforated or laser scored tear strip that the consumer would tear off to reveal-the press-to-close zipper. In another embodiment, the perforated or laser scored tear strip is segmented so that the consumer simply tears off more of the strip to expose a larger and longer opening to gain better access to the contents of the package as the contents are removed over time. The ability to access the contents through the side of the bag allows the consumer the ability to pour or scoop the contents of the package with equal ease from a filled package to an almost empty package. This side access is in sharp contrast to access through the top of conventional bags or packages wherein the consumer is required to reach further into the package as the contents are removed, thereby making the retrieval of the contents more difficult as the package is emptied over time.

Another object of this invention is to provide a package or bag having a longitudinally extending easy-open re-closable access opening spaced below the top of bag opening through which the bag is filled thereby enabling the top end of the bag to be sealed without having to seal through the easy-open re-closable feature. Therefore, there is little, if any, likelihood of channel leakers occurring.

While a package having the easy open re-closable feature and having gussets which maximize distribution efficiencies (by reducing bag size and improving package appearance) is a preferred embodiment, the easy open re-closable feature can be provided for multi-wall pre-made bags, poly laminate pre-made bags, poly and poly laminate "Lincube" bags or co-extruded poly bags. Further, vertical form fill seal (VFFS) equipment may be employed to produce poly laminate and co-extruded poly with or without (four corner fin seal) gusseted packages and non-gusseted packages, with or without applying the re-closable feature on-line (pre-applied film with zip-fin) with the VFFS machine. Moreover, packages of the type disclosed herein (longitudinal location of the closure) may be produced on existing packaging equipment ranging from pre-made bag equipment to both horizontal and vertical form seal machines.

DESCRIPTION OF THE PREFERRED EMBODIMENT

Figures 1, 2:
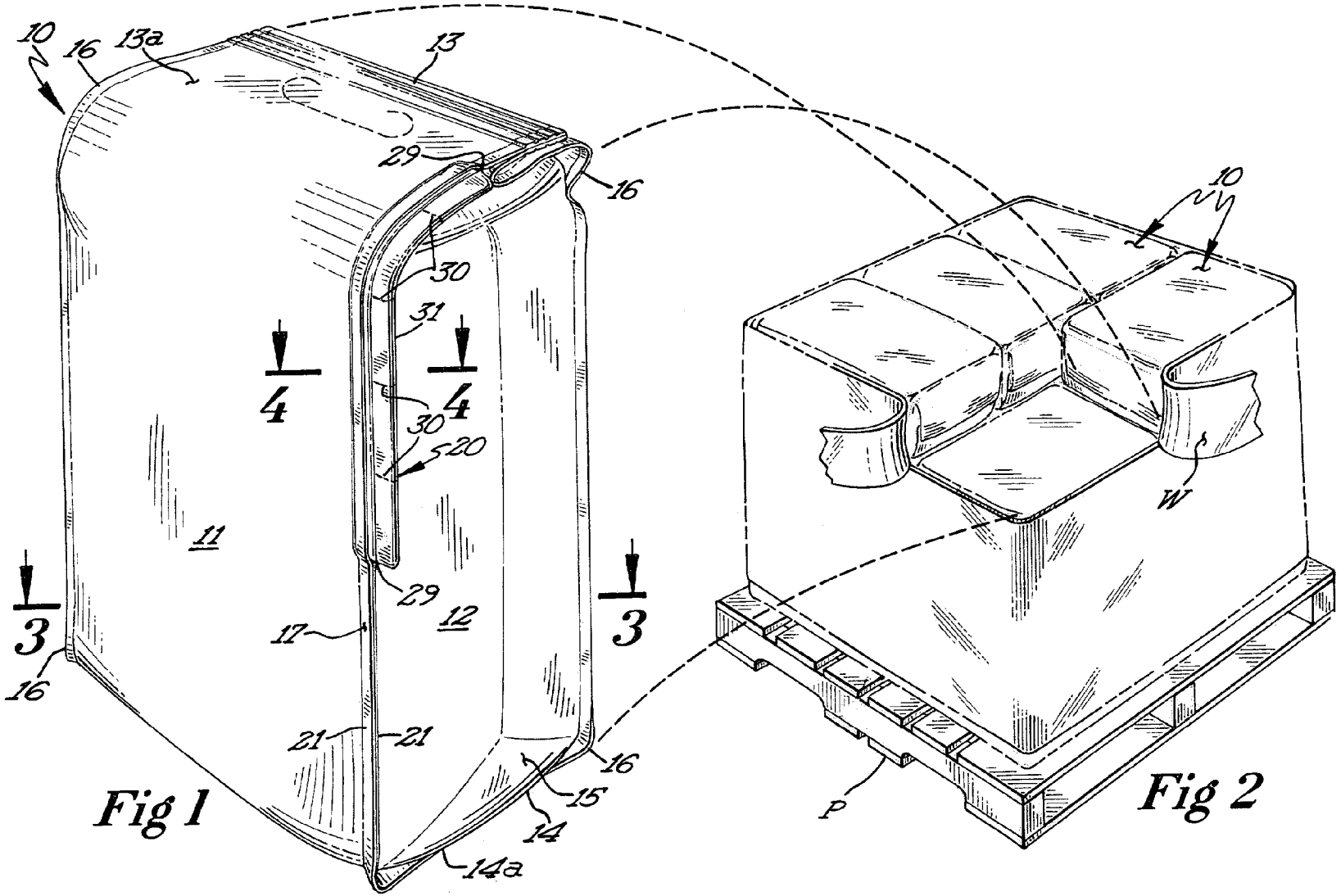
FIG. 1 is a perspective view of a fin type bag (zip-fin bag) having the easy open re-closable device.
FIG. 2 is a perspective view of a conventional pallet loaded with the type of bag disclosed in FIG. 1.

Referring now to the drawings and more particularly to FIG. 1 it will be seen that a filled bag 10 incorporating an easy open re-closable device 20 is there shown. The bag 10 is fin type bag formed from flat stock, usually a poly laminate film or co-extrude poly film, and includes opposed side panels 11, opposed end panels 12, a sealed upper end 13 and a sealed lower end 14. This particular embodiment of the bag 10 has gussets 15 in the opposed ends. The filled bag 10 also has a flat top 13*a* and a flat bottom 14*a*.

Figure 3:
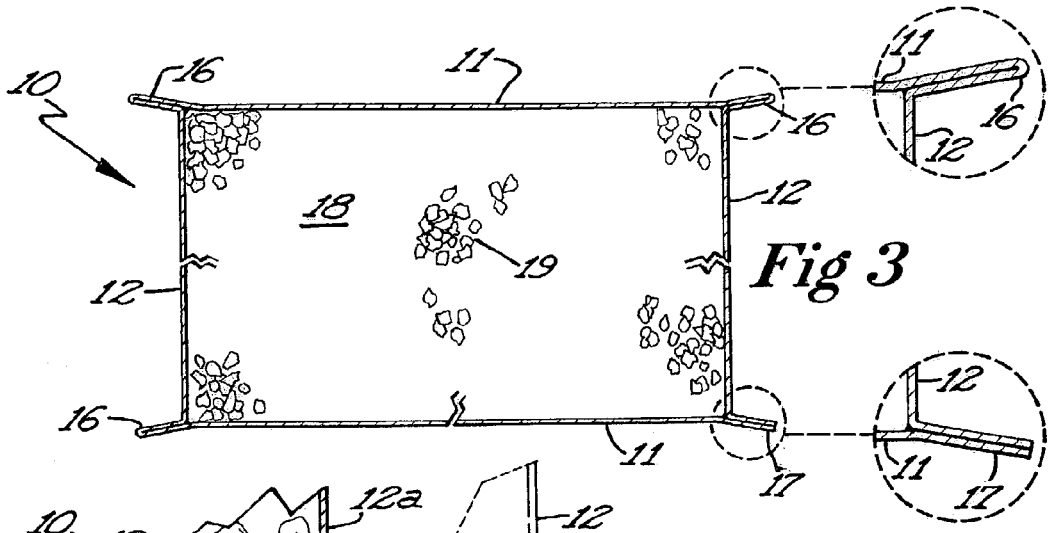
FIG. 3 is a cross-section of view taken along line 3-3 of FIG. 1 and looking in the direction of the arrows.

Referring now to FIG. 3, it will be seen that the bag 10 includes four fins which are located at the corners of the bag. Three of the fins 16 are folded over and sealed during the formation of the bag while the remaining fin 17 forms a sealed seam fin. In this embodiment, the elongate access opening 17*a* (FIG. 6) is formed in the seam fin 17 and extends longitudinally of the bag in vertical orientation. The access opening is closed by an easy open re-closable device 20. It is important to note that the re-closable device for closing the access opening is spaced from the sealed top and bottom ends of the bag.

It is pointed out that the bag 10 has a vertical dimension, a transverse dimension (width of a side panel), and a width dimension (width of an end panel). The longitudinal dimension of the bag as used herein is the vertical dimension of the bag in its normal presentation. It is pointed out that FIG. 4-6 have been used to show two modifications of the bag and closure device. The phantom line configuration corresponds to one modification and the full line configuration corresponds to another modification of the bag of FIG. 1. The essential difference is the size of the fin and the inclusion of the closure device in a corner fin 16 rather than the seam fin 17 of FIG. 1. The features of the fin will remain substantially the same (other than size).

The protruding zip-fin structure of FIG. 1 could be produced by slitting the corner fin 16 at the corner and mounting the single ribbon zipper or slider so as to protrude out from the edge of the corner fin seal 16 or from the corner seam fin 17 or from a seam fin not located at a corner of the package but rather adjacent to a corner of the package or a back seam fin.

Figure 4:
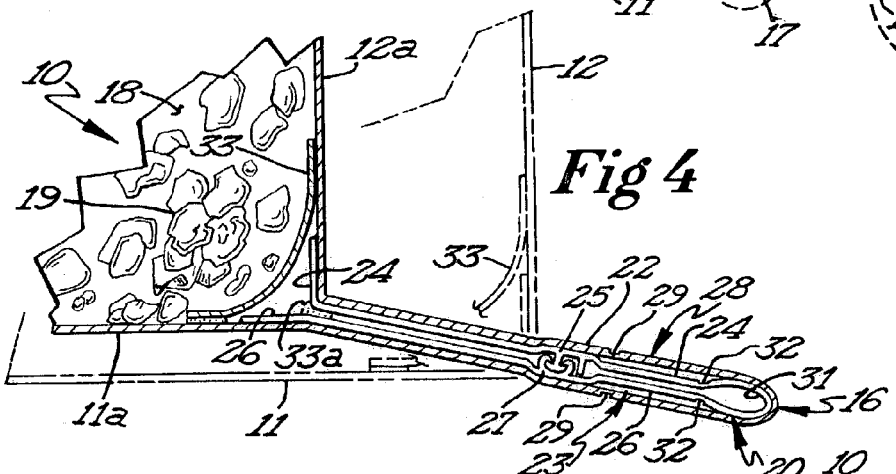
FIG. 4 is a cross-sectional view of a modified form of a bag as illustrated in dotted line configuration, the full line configuration depicting another modified form of the bag and closure taken along the same cutting plane.
Figure 5:
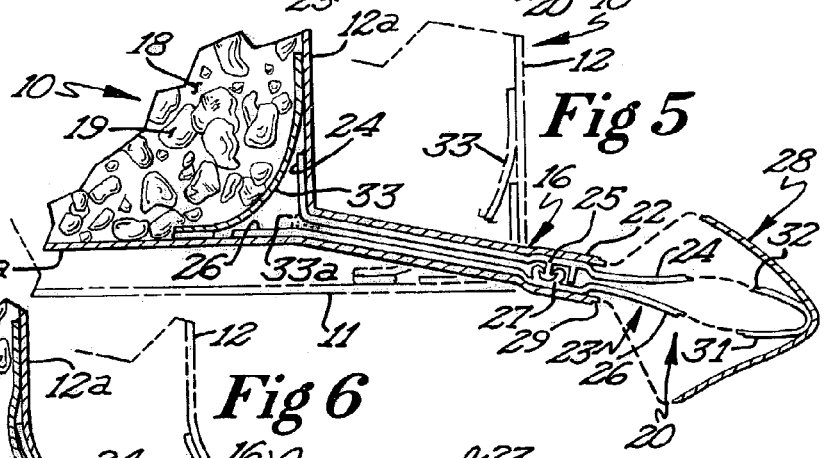
FIG. 5 is a cross-sectional view illustrating the modifications of FIG. 4 showing the initial step in opening the closure.
Figure 6:
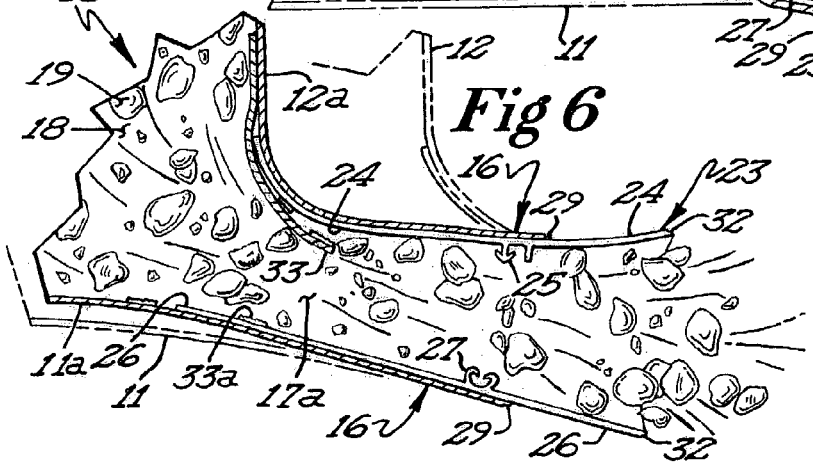
FIG. 6 is a cross-sectional view similar to FIG. 4 illustrating the modifications of FIG. 4 and showing the closure in the fully open position.

The re-closable device 20, as best seen in FIG. 4-6, is located in a corner fin 16 and includes press to close device type closure 23 secured to the inner surfaces of the lips 21 of flanges of the fin. It is pointed out that slider type closure will work equally as well as the press to close closure device. The particular closure shown is a single ribbon closure although other types of closure device may also be used. The lips 21 are slightly enlarged as at 22 for the extent of the access opening. The press to close device closure 20 includes a single ribbon or strip including a portion 24 having a male closure element 25 and a strip portion 26 having a female closure element 27 thereon. The strip portions 24, 26 are secured to the inner surface of the lips or flanges 22 and extend throughout the length of the access opening. Since the bag of FIG. 1-6 use a zipper or press to close closure device, these bags will be referred to as zip fin bags. Zip fin bags may also use a slider type closure device as well as other type of zippers.

This particular closure device 20 is preferably attached (sealed) to the film forming the fin prior to folding the fin during formation of the bag. The closure device 20 is a press to close type and is opened by forcibly pulling the strips apart. The outer arcuate portion 28 of the fin is longitudinally (vertically) scored as at 29 on both sides of the closure to permit this arcuate portion 28 of the fin to be torn away to access the closure. This tear away portion or strip 28 is also transversely scored at longitudinal spaced locations 30. These transverse score lines 30 enable a user to tear off portions of the strip 28 to permit incremental opening of the access openings as the contents of the bag are progressively removed.

The arcuate outer end portion 31 of the single ribbon closure device joining the strip portion 24, 26 is sealed to the inner surface of the tear away strip 28. The strip portions 24, 26 are also scored longitudinally and transversely of the fin at 32. When the segmented tear away strip 28 is torn away, the arcuate outer end portion 31 of the closure is also torn away thereby exposing the closure. It is pointed out that a dual ribbon closure may be used in lieu of the single ribbon closure device and would not require scoring and attachment to 28. With a dual ribbon closure the tear off section 32 would not exist. As a result when tear off strip 28 is removed the flanges of the dual ribbon zipper will be exposed allowing the consumer access to the contents of the package by pulling apart the zipper flanges.

The bag shown in the both embodiments of FIG. 4-6 has a fin 22 extending outwardly of the associated side panel and end panel. When the tear away strip 28 and zipper cover 31 are removed, the outwardly projecting strip portions 24, 26 provide convenient pouring spout which may be controlled manually by pulling up on the top of the bag when the bag is tilted to pour. When the top is pulled upwardly, the access opening becomes a slit. Relaxing this upward pull enlarges the access opening. The user may control the size of the access opening using this technique. Pulling upwardly on the top of a tilted bag produces a pinch valve on the access opening.

The zip fin bag 10 is also provided with a tamper evident element 33 which is secured to the inner surface of the bag. The tamper evident element or strip 33 extends longitudinally the length of the access opening. In the embodiment shown, one side of the strip 33 is hard-welded to the inner surface of the bag while other side is yieldably attached to the inner surface by the tamper evident sealant. When the bag is opened and pressure is applied to the tamper evident strip 33, the strip 33 will tear away from one side (FIG. 6), thereby exposing the bag interior and contents to a consumer.

The presence of a tamper evident strip 33 informs a consumer that the bag has not been tampered with. Further, the tamper evident strip 33 also increases the resistance of the bag to burst when inadvertently dropped from a predetermined height. In the conventional drop test, the tamper evident strip 33 resists the shear force produced by dropping and adds to the integrity of a bag. Thus the shipping strength of the bag is increased in the area of the access opening. It is also pointed out that the external tear away strip for the closure device also serves as a tamper evident element. Referring to FIG. 5, an alternative to the temper evident strip 33 is there shown. The peel seal 33*a* could be used instead of a tamper evident strip especially on small packages.

It will be noted that the access opening and re-closable device 20 is not only located longitudinally (vertically) of the bag, but in a preferred embodiment it is also located between intersecting planes. However, the access opening and re-closable device may also be located at any longitudinal position on the bag and is not limited to a corner. In the embodiment of FIG. 1-6, the easy open re-closable device 20 located at the junction corner of an end panel 12 and a side panel 11. The re-closable device also extends to the natural top 13*a* of the bag. When the bag is filled, the associated end panel 12 and side panel are under tension. Similarly, the radius defined by the upper curved end of the reclosable device causes the adjacent portions of the bag to be under tension. When the reclosable device is unzipped or opened, the access opening is caused to naturally open due to this tension. This opening response due to tension cannot occur when the access opening is located in a single plane which typifies the prior art. It is pointed out that the embodiment of FIG. 1 is also provided with a tamper evident element.

By spacing the ends of the re-closable device from the sealed ends 13, 14 of the bag, the problem of channel leakers is avoided in plastic poly bags It will be appreciated that if the re-closable device 20 extended to the end seal(s) 13, 14 of the bag, the transverse end seal(s) would extend across and crush the end(s) of the re-closable device. Because of the added thickness of the re-closable device 20 when sealing across this added thickness, channel leakers can be produced and the interior of the bag is then compromised. Communication of the interior of a bag with the exterior through a channel leaker can lead to contamination of certain products within the bag. Channel leakers are avoided when the longitudinally oriented re-closable device is spaced from the ends of the bag.

It will be seen that the closure device 23 may be positioned within the seam fin 17 in the embodiment of FIG. 1 or the closure device could be used with any of the fins 16 of the zip fin bag 10. Further, various kinds of closure devices may be used in lieu of the squeeze to close zipper shown in FIG. 1-6. For example, the closure device could be a Velcro (hook and loop) device. In this arrangement, the zip fin would be provided with a tear away strip and a tamper evident strip in the manner of FIGS. 1-6. The hook and loop fasteners would be externally of the fin flanges but inwardly of the tear strip. To reclose the access opening, the consumer would roll the fin flanges inwardly to mate the hook and loop fasteners. It is also pointed out that the closure device may be located in seams other than corner seams. In certain plastic or poly bags, there is a back seam located between the ends of a panel. The closure device could be located in such a seam or other seams of the bag such as a seam fin near or adjacent one of the corner fins.

A tape re-close closure could also be used which would use perforated or laser scored tear strip in the manner of FIG. 1-6 and a tamper evident strip. The tamper evident strip would be permanently welded along one vertical edge and attached with a tamper evident sealant (FIG. 1-6) along the other vertical edge. The tamper evident strip would be forcibly opened and pulled through the access opening. One surface of tamper evident strip would be provided with peel seal adhesive which would be removed to permit the tamper evident strip to function as, a closure.

Figure 25:
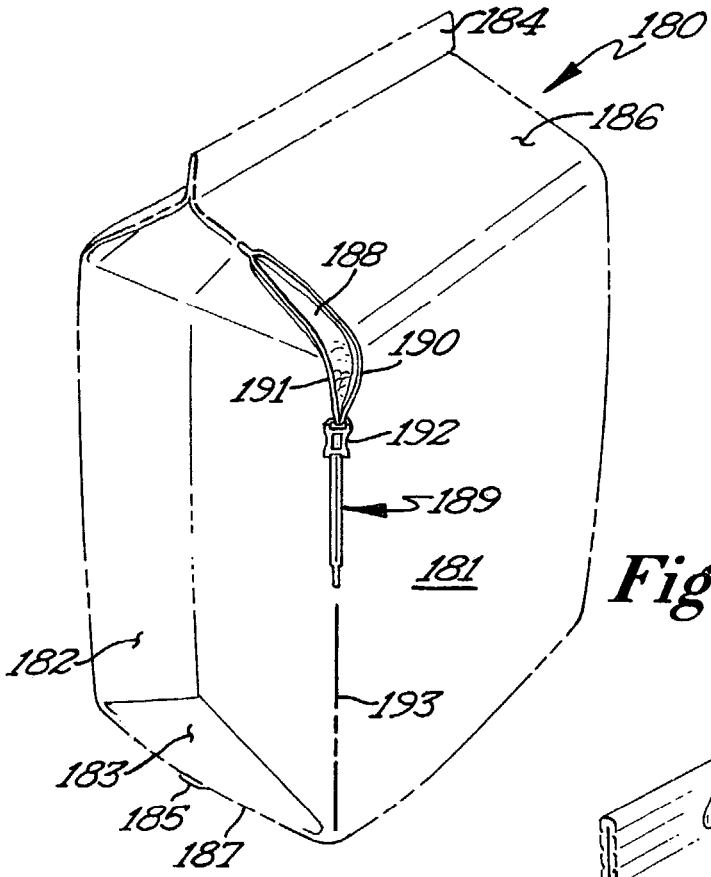
FIG. 25 is a perspective view illustrating another embodiment of a bag having closure device partially open for accessing the contents of the bag.

A slider type closure could also be used (See FIG. 25). Sliding the tab in opposite directions would selectively open or close the access opening. Further, the closure could be omitted from the zip fin bag and access to the interior of the bag could simply involve removal of the perforated or laser scored tear strip. A tamper evident element peel-seal and the tamper evident internal tear strip for heavier packages could be provided for additional protection and the securing of the package's integrity. It is also pointed out that the closure device may be used on non-fin bags. For example, a slider type closure or a single or dual ribbon type closure could be secured to a bag and project through a longitudinal slit in the bag or mounted externally on the outside of the package and over the longitudinal slit.

One of the important advantages of the longitudinal location of the access opening and easy open closure is the reduction of headspace. The focus of the prior art is to locate the closure across the top of the bag (transverse positioning) in the same opening in the package or bag that is used to fill the bag. This transverse seal including the closure requires additional headspace in the top of the package that increases package costs and package size. This additional headspace not only increases package size but also increases shipping volume. On the other hand, the longitudinally positioned closure reduces headspace which yields a potentially tightly filled package that utilizes less packaging material. This advantage produces the benefit of better presentation of the package to the consumer and more efficient utilization of material to shelf presentation for packages typically ranging from less than one (1) kilogram up to twenty five (25) kilograms.

In short the longitudinal location of the closure creates the economics to put the package savings and distribution savings toward the cost of the zip-fin bag or other longitudinal access packages and make the features and package commercially viable for many products.

Another advantage of the longitudinal position enables packages to be producted with a single zipper ribbon since the package is filled through an opening other than the access opening provided with the longitudinal re-close. This eliminates alignment and stretch problems associated with applying dual ribbon strips. Instead of applying two ribbons that need to align correctly for the interlocking members to interface, you would only need apply one ribbon that is self aligning for the interlocking members. The ability to use a single zipper ribbon also creates a natural tamper evident feature and potential tear strip. Also, the application of the tamper evident that is not in the filling opening provides a different style of tamper evident that can also improve the integrity and strength of the package in the area directly adjacent to the access opening that the tamper evident strip covering.

Another important advantage of the zip fin bag or package is the ability of the production of bags on existing vertical form fill seal (VFFS) equipment and existing horizontal form fill seal (HFFS) equipment. The longitudinal location of the zip-fin closure allows the use of VFFS machines and HFFS machines to seal the ends of package without intersecting the zip-fin closure thereby eliminating channel leakers. The zip-fin closure and tamper evident element may be pre-applied to the film which allows the film producer or converter to supply film with an integrated closure and tamper evident feature that can be utilized on existing VFFS and HFFS machines. Existing VFFS and HFFS using pre-applied zip-fin film having the potential for producing easy-open, tamper evident, re-closable packages in the form of tube bags with zip-fins, stand-up pouches with top and bottom gussets including a zip-fin, and a four corner edge sealed gusseted bag with a zip-fin. It is also pointed out a pre-applied zipper type closure to a film creates a ridge on the film. This ridge on the film serves a guide to maintain registration of the film as it drawn through the VFFS or HFFS machines.

Figure 7:
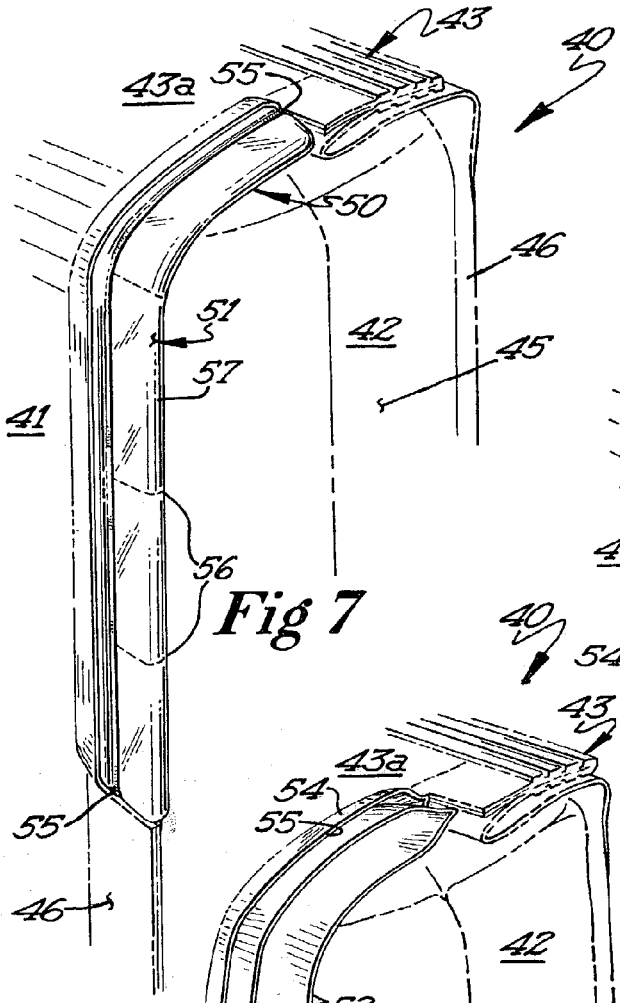
FIG. 7 is a fragmentary perspective view of the embodiment of the bag of FIG. 1 illustrating the segmented tear away strip cover for the re-closable device allowing incremental opening thereof.
Figure 8:
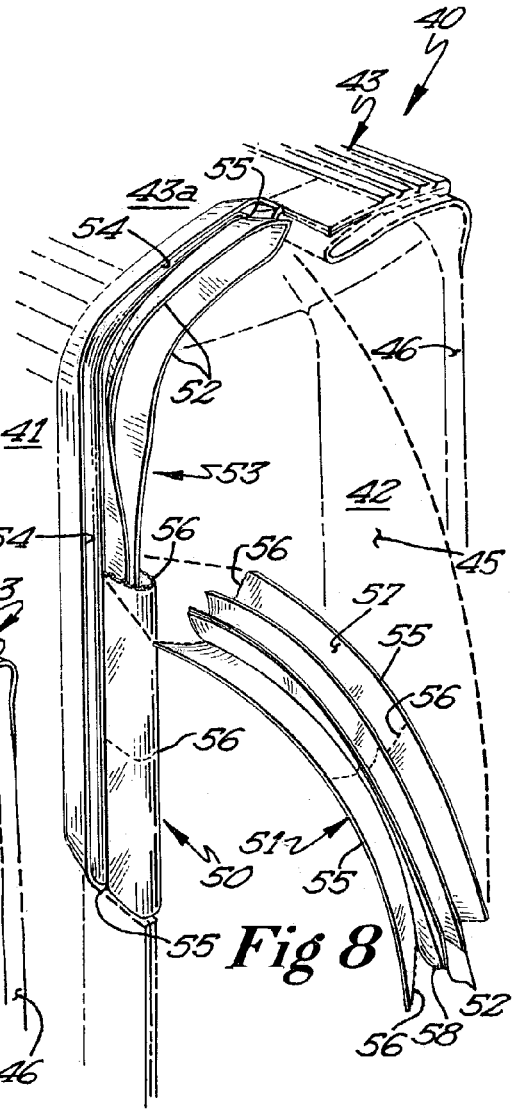
FIG. 8 is a partially exploded fragmentary perspective similar to FIG. 7 illustrating the segmented tear away strip of the re-closable device partially torn away to expose a portion of the re-closable device.
Figure 9:
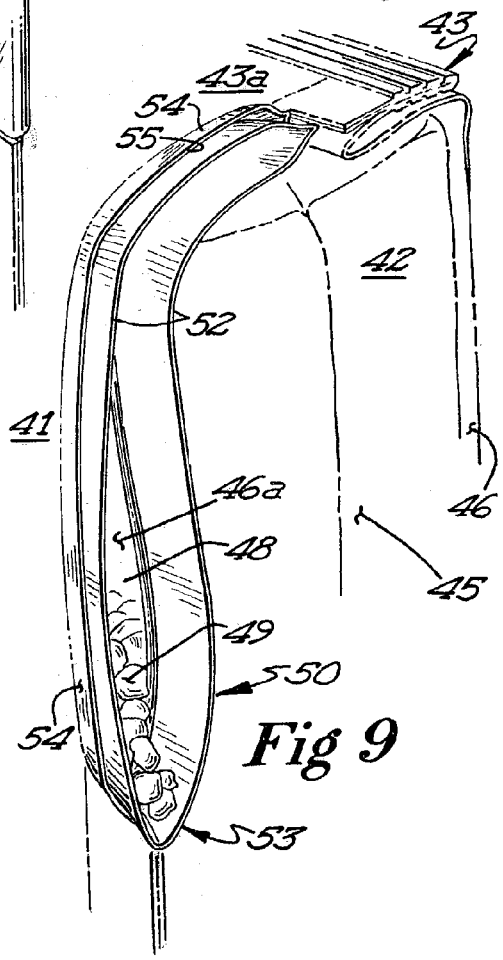
FIG. 9 is a fragmentary perspective of the embodiment of FIG. 1 and similar to FIG. 7 illustrating the segmented tear away strip removed and the re-closable device partially opened.

Referring now to FIG. 7-9, it will be seen that a modified form of bag is there shown. The bag or package 40 is similar to the bag 10 of FIGS. 1-6 and is a zip-fin polymer bag including opposed side panels 41, opposed end panels 42, a sealed upper end 43, a sealed lower end 44, end gussets 45, and corner fins 46. The contents 49 fill the interior 48 of bag forming a natural flat top 43*a* and a natural flat bottom. The easy open re-closable device 50 is mounted in a corner fin 46 although the closure device could be used with the seam fin. The closure device 50 is similar to that illustrated in FIG. 1-6 and includes male and female elements which are pressed to close. The male and female elements are mounted on strip portions of the single ribbon closure device 53 and are secured to the lips or flanges of the corner fin 46. A dual ribbon closure could also be used in lieu of a single ribbon closure. The fin 46 is perforated or laser scored longitudinally along both flanges 54 and the fin is also transversely scored at 56.

With this arrangement, the segmented tear away strip of the fin may be incrementally torn away to reveal a portion of the zipper. It will be noted that the strips of the closure device or zipper 53 are also longitudinally and transversely scored to permit the arcuate portion or cap 58 of the zipper to be incrementally torn away. In this regard the cap 58 of the zipper is attached to the tear away cap or strip 57 and is incrementally removed therewith. In FIG. 8, the tear away strip 57 and cap 58 are partially removed exposing a portion of the closure device 53 which is partially opened allowing access to the contents through the access opening 46*a*. In FIG. 9, the tear away strip 57 along with cap 58 are completely removed. The bottom portion of the closure device 53 is open while the top portion is closed. This is an illustration of accessing the interior of the package to the desired level of the package's content as the package is progressively emptied. However, the tear away strip and cap need not be segmented thereby allowing the entire tear away strip and cap to be removed in its entirety. In the event a dual ribbon is used, the cap does not tear away.

Figure 10:
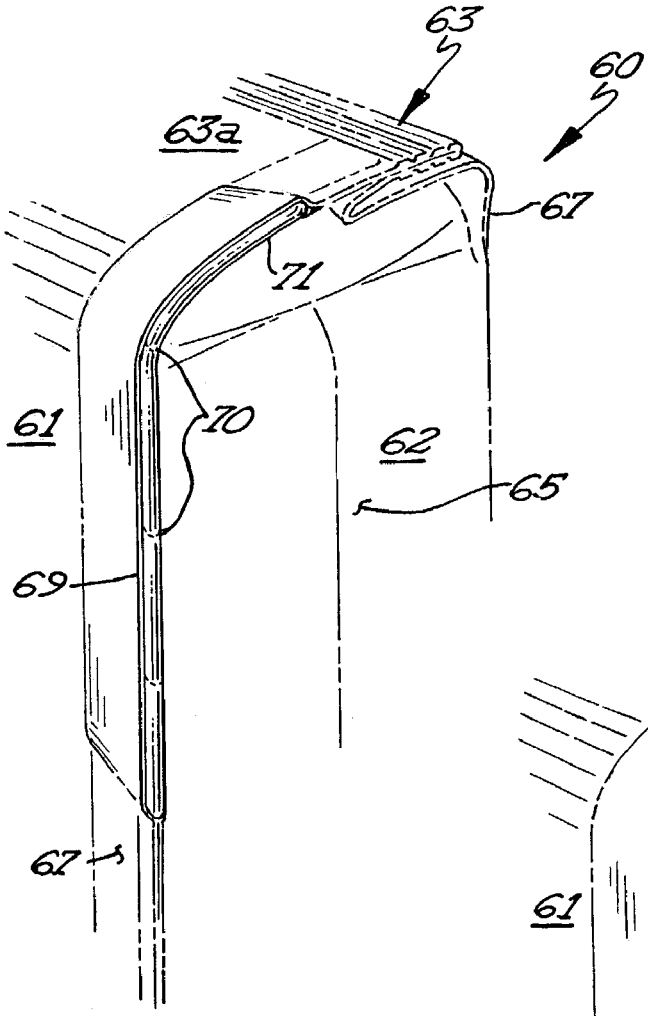
FIG. 10 is a fragmentary perspective view of the embodiment of FIG. 10 illustrating the segmented tear away strip for the re-closable device partially torn away.
Figure 11:
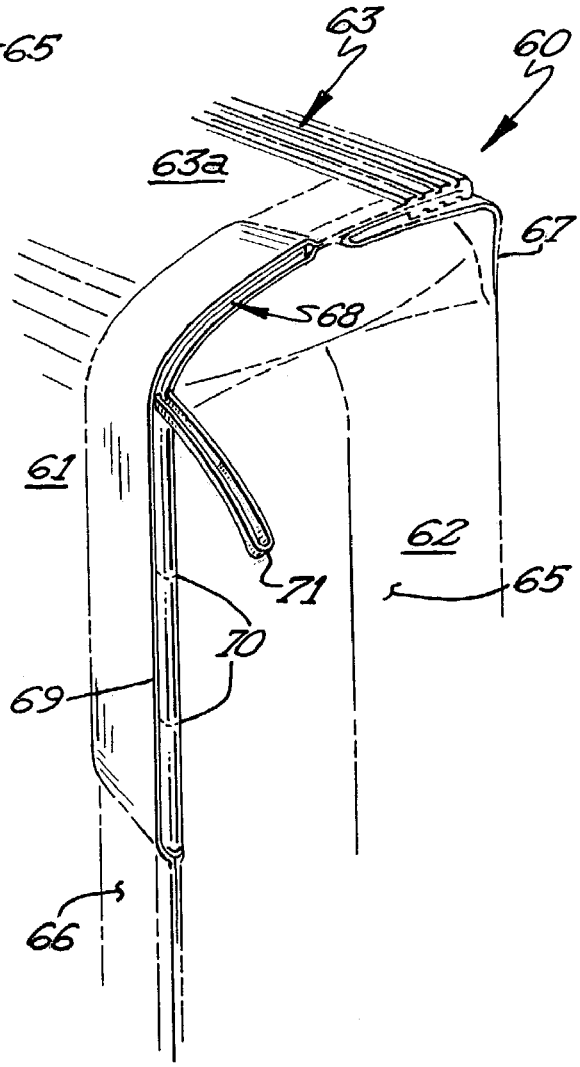
FIG. 11 is a fragmentary perspective view of the embodiment of FIG. 10 illustrating the segmented tear away strip for the re-closable device partially torn away.

Referring now to FIG. 10 and 11, a modification of the package and closure device is there shown. The package or bag 60 is essentially the same as that shown in FIG. 1 and the other embodiments. The bag 60 is a zip-fin bag and is formed of a poly laminate or co-extrude poly and includes opposed side panels 61, opposed end panels 62, a sealed upper end 63 and sealed lower end. The end panels have gussets 65 and the filled bag has a flat top and bottom.

The bag 60 also has corner fins 66, (folded over and sealed) and a seam fin 67, The fins 66, 67 are similar to the fins depicted in dotted line configuration of FIGS. 4-6 and the single ribbon press to close closure device 68 positioned within a corner fin 66. A slider closure may also be used in place of the press to close closure device in this embodiment. The access opening and closure device are oriented longitudinally (vertically) of the bag and are spaced from the sealed ends.

The strip portions of the single ribbon closure device 68 are longitudinally laser scored at 69 and transversely scored at 70 to define a tear away strip or cap 71. The transverse scoring maybe omitted to allow removal of the entire strip. The tear away strip 71 may be incrementally removed as illustrated in FIG. 11 allowing controlled access to the content of the bag as the bag is emptied. The fins 66, 67 of the bag shown in FIGS. 10 and 11 do not project outwardly of the side and ends as the fins shown in full line configuration of FIGS. 4-6. This minimizes snagging of fins with any structure that may be encountered by-the bags.

Figure 12:
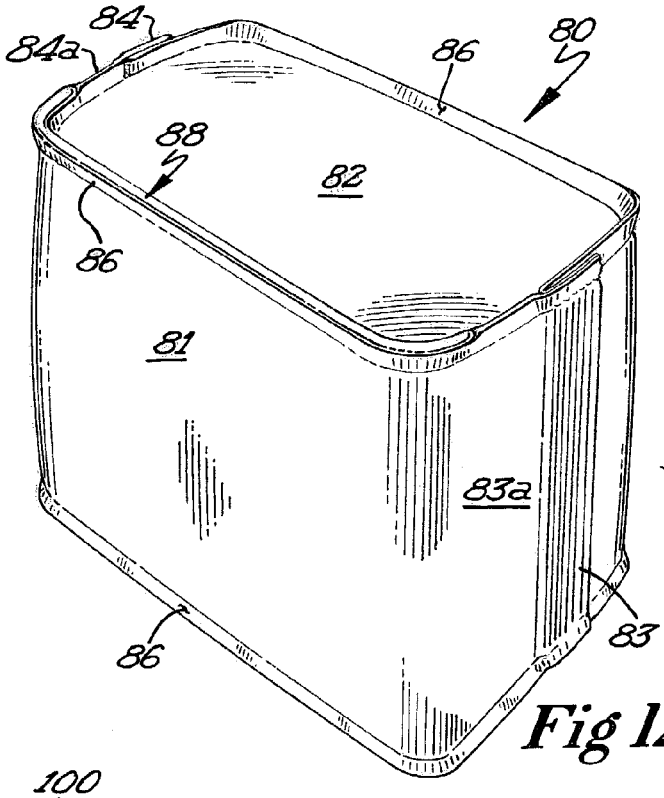
FIG. 12 is a perspective view of an embodiment of a filled bag incorporating the re-closable device illustrating the bag rotated 90° from its normal orientation for the purpose of stacking and shelf presentation.
Figure 13:
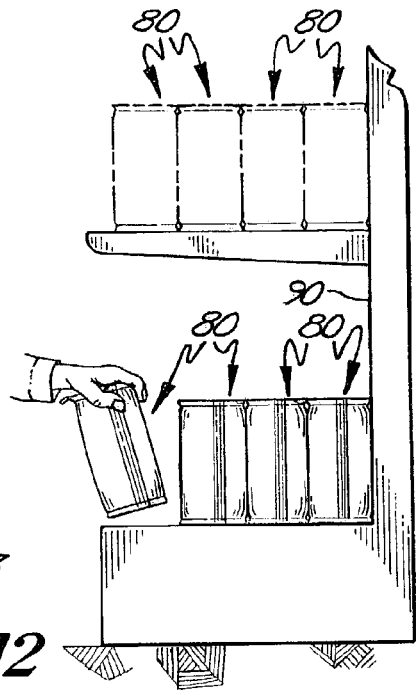
FIG. 13 is an elevational view diagrammatically showing the shelf presentation and stacking of the bags of FIG. 12.

Referring to FIGS. 12 and 13 it will be seen that a zip-fin bag generally similar to the bags of FIGS. 1-11 is illustrated in a presentation position rotated 90° from the position illustrated in FIGS. 1-11. The bag 80 includes side panels 81, end panels 82, an upper sealed end 83, a lower sealed 84, and corner fins 86. Although not shown, the bag 80 will have a back seam since this bag is formed with VFFS equipment. When the bag is filled, the bag has a flat top 83*a* and a flat bottom 84*a*. A single ribbon type closure 88 similar to the closure of FIGS. 1-11 is located in a corner fin 86 and is longitudinally oriented (vertically). The closure 88 closes an access opening (not shown) and extend the entire vertical extent of the fin 86. The closure actually extends arcuately around the flat top and bottom of the package but terminates in spaced relation to the sealed ends.

The bag is rotated 90° for stacking on store shelves 90 as shown in FIG. 13. It is pointed out that the package 80 may have printing on the panels which extend longitudinally of the panels. For example, the printing may be applied to a side panel 81 such that one reads the printing from left to right. The reduced headspace allows the tightly filled bag 80 to be oriented in this fashion. This type of presentation and stacking cannot be effectively done with prior art bags that include a transverse re-close, having the large and mostly wasteful headspace needed to allow for transverse re-close. It is pointed out that all of the bags of FIGS. 1-12 may be provided with a tamper evident strip element. It is further pointed out that a peel seal tamper evident element may be used instead of the strip. It is further pointed out the bags of FIGS. 1-12 may be produced without either of the disclosed tamper evident elements 33 and 33*a*.

Figure 14:
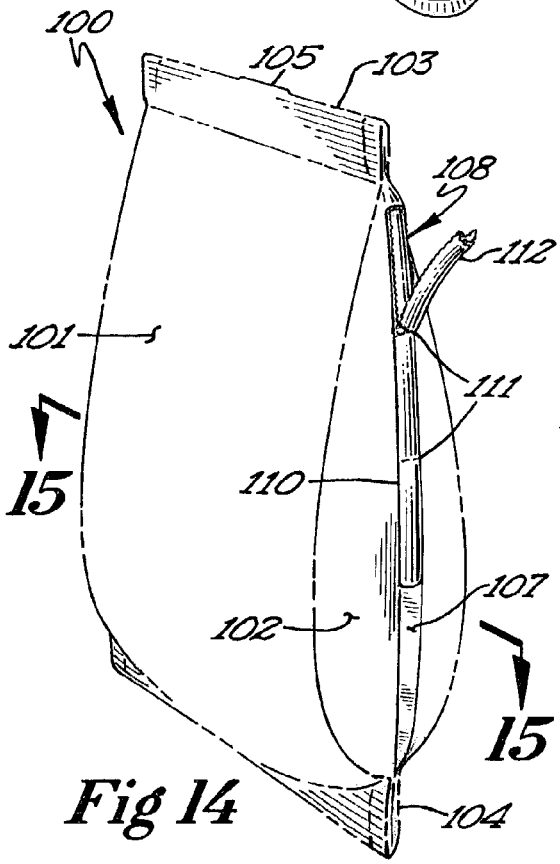
FIG. 14 is a perspective view of a tube bag illustrated in dotted line configuration showing an embodiment of a novel closure device in partially opened position.
Figure 15:
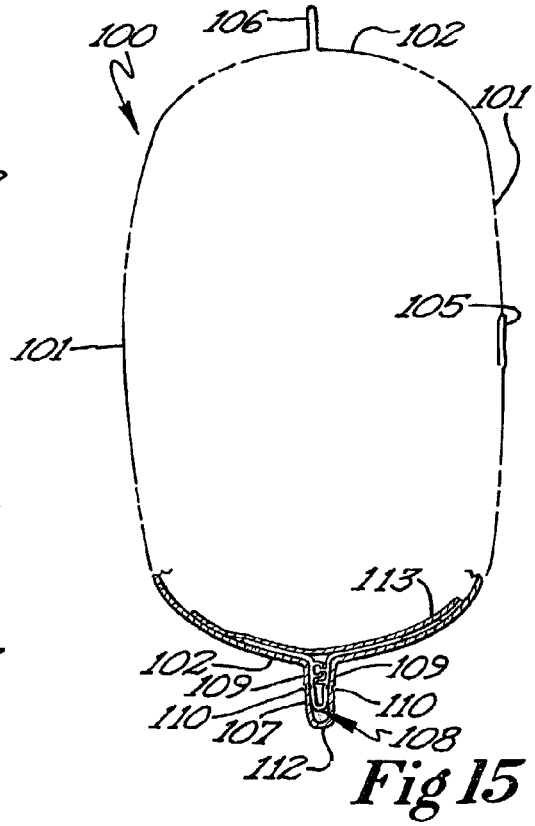
FIG. 15 is a cross-sectional view taken along line 15-15 of FIG. 14 and looking in the direction of the arrows.
Figure 16:
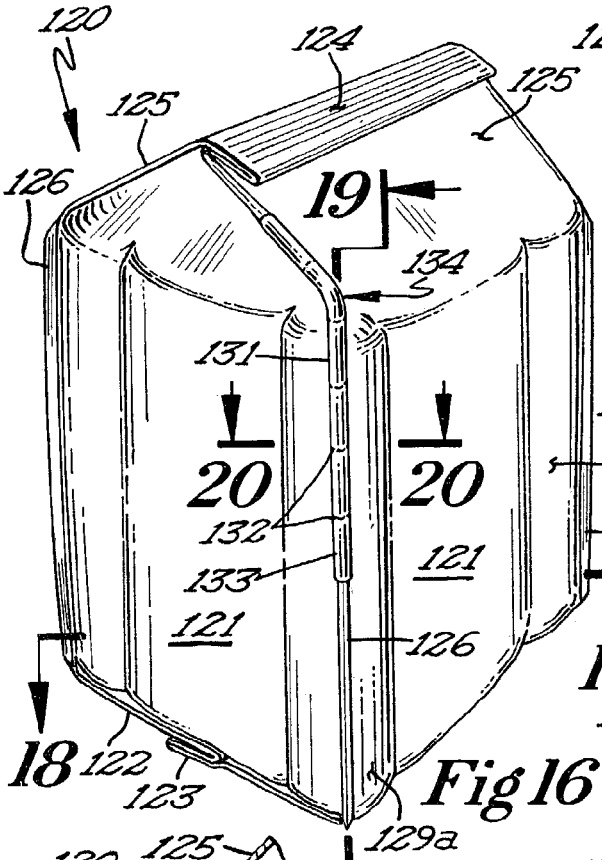
FIG. 16 is a perspective view of a "Lincube" bag having a novel closure device.

Referring to FIGS. 14 and 15, it will be seen that a tube bag 100 is there shown and when filled includes opposed side panel 101, opposed end panels 102, a sealed upper end 103 and a sealed lower end 104. A seam 105 joins the edges of the film when forming the bag. The tube bag 100 also has fins 106 and 107 located in the end panels and extending longitudinally of the bag. It is also pointed out that tube bag 100 may alternatively omit fin 106.

The fin 107 has the access opening and single ribbon closure device 108 therein. A dual ribbon closure device can also be used with the tube bag embodiment. The flanges or lips 109 of the fin 107 are longitudinally perforated or laser scored as at 110 and are transverse laser scored (or perforated) at 111 such that the arcuate portion of the fin defines a tear away strip 112. The segmented tear away strip 112 with the closure device cap (not shown) may be incrementally torn away to expose the single ribbon closure device 108. The transverse scores may be omitted to allow removal of the entire. strip. It is pointed out that the strip portions of the closure device having the mating male and female elements secured thereto are secured to the inner surfaces of the fin flanges. The bag 100 is also provided with a tamper evident strip 113 similar to the tamper evident strips of the embodiments of FIGS. 1-6. The bag 100 may also be provided with a tamper evident peel seal instead of the tamper evident strip 113. Further, the bag 100 may also be provided without either of the disclosed tamper evident elements. It will be seen that the closure device 108 extends longitudinally of the bag but is spaced from the end seals 103, 104. It is also pointed out that arcuate or radius configuration of the end panels 102 containing the fins are also under tension when the bag is filled causing the access opening to naturally open when the closure 108 is opened. The longitudinal location of the closure allows the bag to be made with a reduced headspace and still provide an easy open re-close feature with various tamper evident features that also can. improve the package integrity in the area of the access opening.

Referring now to FIGS. 16-20, it will be seen that a Lincube bag incorporating a uniquely located closure is there shown. The Lincube bag is formed of a co-extruded poly or poly laminate, and when filled, has four side panels 121 of equal or similar size, a flat bottom wall 122, a lower sealed end 123, an upper sealed end 124 and an inclined upper wall 125. The inclined upper wall 125 is actually inclined upwardly from each of the side panels thereby generating four upper panels terminating at the upper seal 124.

Figure 17:
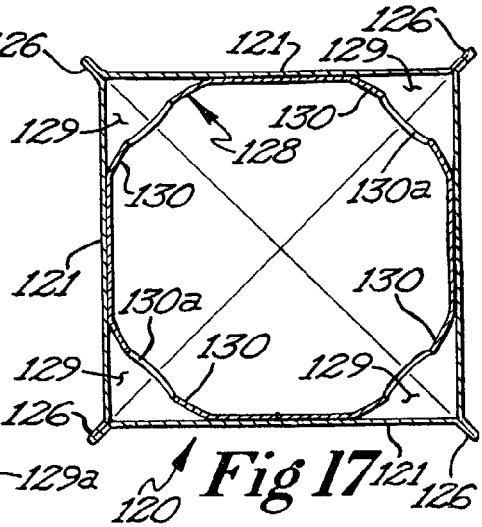
FIG. 17 is a cross-sectional view of the bag of FIG. 16 showing details of construction of the bag in an unfilled or empty condition.
Figure 18:
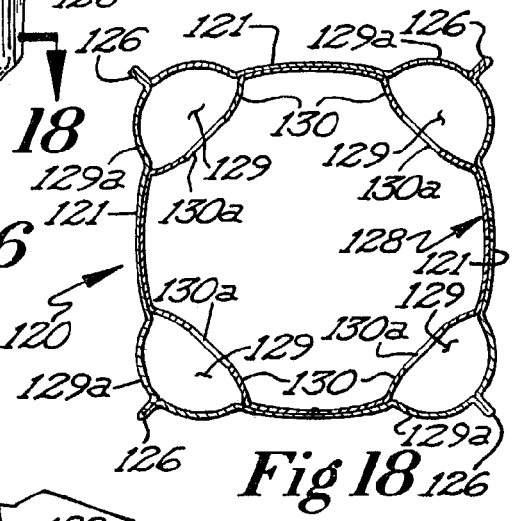
FIG. 18 is a cross-sectional view taken along line 18-18 of FIG. 16 and looking in the direction of the arrows.
Figure 19:
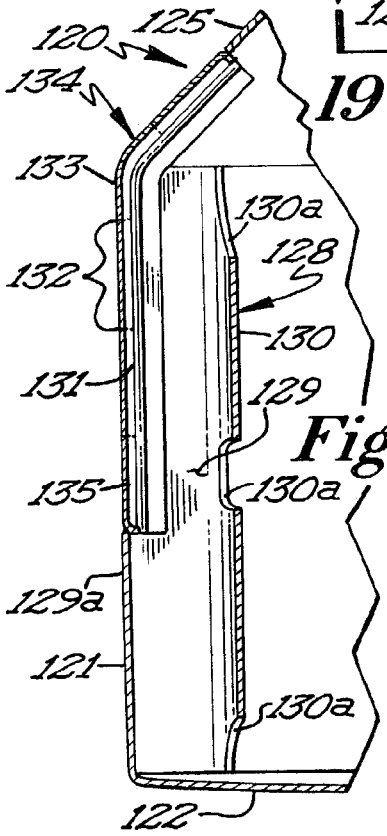
FIG. 19 is a cross-sectional view taken along line 19-19 FIG. 16 and looking in the direction of the arrows.
Figure 20:
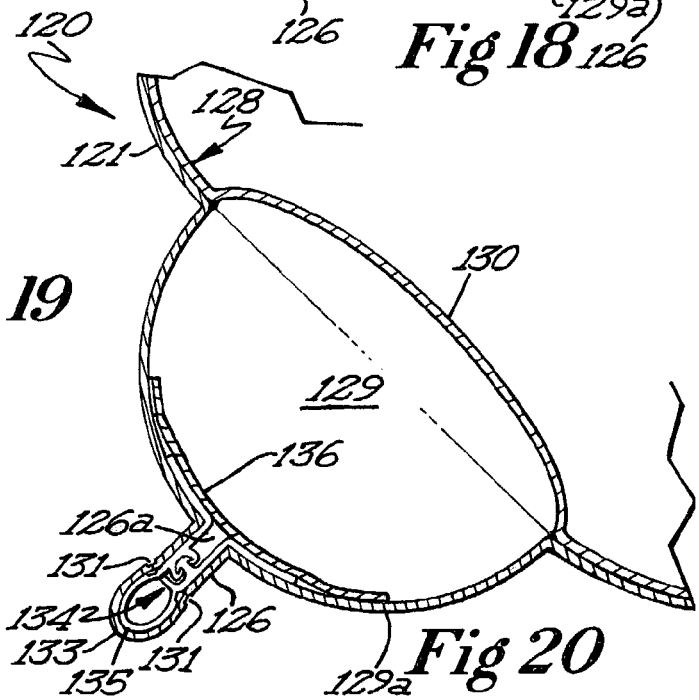
FIG. 20 is a cross-sectional view taken along line 20-20 of FIG. 16 and looking in the direction of the arrows.

The bag 120 is a fin bag having corner fins 126 at the four corners thereof. The bag 120 is also provided with a plastic strip secured to the side panels 121 of the bag and defining a liner 128. As best seen in FIGS. 17 and 18, the liner 128 is secured to the mid portions of the side panels but is not secured to the panels adjacent the corners of the bag. Therefore vertical volumetric spaces 129 are defined at the corners between the bag and the liner. When the bag is filled with a product, the volumetric spaces 129 are also filled with the product. The filled corners then serve as support columns 129*a* for the bag as the contents within the liner are removed thereby allowing the bag to maintain its structural identity. The bag 120 could be constructed without fins and a single ribbon or dual ribbon could be mounted internally or externally of the bag. A slider could also be mounted internally or externally of the bag.

It will be noted that the unattached portions of the liner 128 located adjacent the corners of the bag are relieved adjacent the upper and lower edges of the liner at 130*a*. It will also be noted that one of the corner fins 126 defines an access opening and incorporates a closure device therein. The fin 126 containing the closure device is longitudinally perforated or laser scored at 131 and transversely scored at 132. The arcuate outer portion of the fin defines a tear away cap or strip 133 which may be incrementally removed to expose the single ribbon closure device 134. The closure device 134 includes strip portions secured to the inner surfaces of the fin flanges. One strip portion has a male closure element secured thereon and the other strip portion has the mating female element secured thereto. A dual ribbon closure could also be used with the bag 120, a slider could be used with bag 120 or various other embodiments described.

The strip portions of single ribbon closure device have, an arcuate outer end 135 portion which is longitudinally and transversely laser scored or perforated to define a segmented tear away strip secured to the tear away strip 134 of the fin. Incremental removal of the tear strips 133, 135 allows access to the easy open press to close, closure device 134. As the access opening is incrementally opened by the easy open closure, the contents of the bag may be progressively removed, The transverse scores may be omitted to provide a non-segmented strip.

The bag 120 is also provided with a tear away tamper evident strip 136 secured to the inner surface of the bag by a hard weld and a tamper evident sealant. This tamper evident strip could alternatively be completely secured to the inner surface of the bag by a hard weld and would include a perforated or laser scored section in relation to the access opening. To gain access to the contents, the consumer would need to burst the tamper evident strip. The tamper evident strip is disposed in obstructing relation with respect to the access opening 126*a*. When the closure device 134 is opened and the tamper evident element is opened, a consumer will puncture or pierce the adjacent unattached portion 130 of the liner 128 thereby providing access to the contents of the bag. The unattached portion may be perforated to facilitate breaking and accessing the interior.

The longitudinal location of the easy open closure device 134 again allows substantial reduction of the headspace while providing a re-close feature and tamper evident. It will be noted that closure device is spaced from the sealed ends thereby avoiding channel leakers. The location of the closure device in an arcuate column portion of the bag creates the natural open response as a result of the tension in this arcuate portion. Thus the location of the closure devices provides the bag 120 with all of the advantages of the previous embodiments.

Figure 21:
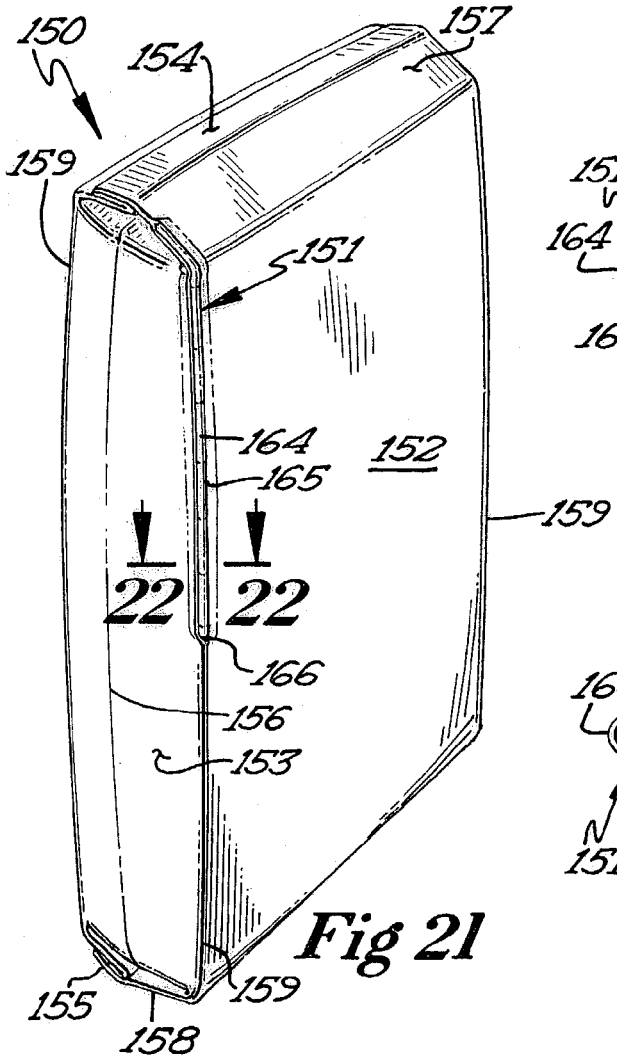
FIG. 21 is a perspective view of a multi-layer paper bag having an uniquely located closure device.

Referring now to FIGS. 21-24, and more particularly to FIG. 21, a multi layer paper bag 150 is there shown and is provided with an easy open re-closable device 151. The paper bag 150 includes opposed side panels 152, opposed end panels 153, a sealed upper end, and a sealed lower end 155. The end panels 153 are provided with gussets 156 and the bag, when filled, has a substantially flat top 157 and a substantially flat bottom 158. The filled bag 150 is generally of parallelepiped configuration and has four longitudinal corners 159. Although the bag 150 is a stand up bag, other kinds of bags may also be used including non-gusseted tube bags.

Figure 22:
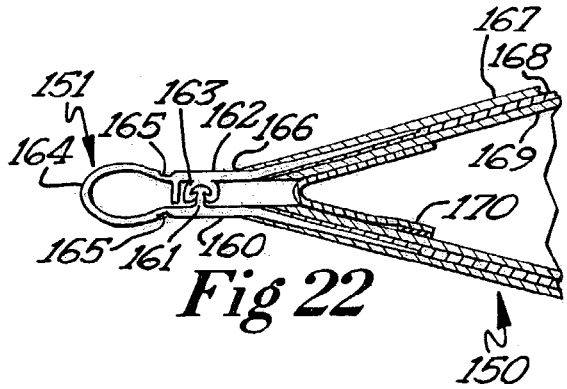
FIG. 22 is a cross-sectional view taken along line 22-22 and looking in the direction of the arrows.

In the embodiment shown, the easy open closure device 151 is longitudinally oriented at one of the corners 159. It is pointed out that the closure device may be positioned a small distance (¼ inch or 1 inch) on either side of the corner rather than at the corner. However, the closure device may be diagonally oriented or it may be transversely oriented. The longitudinal orientation of the closure device 151 is retained in the preferred embodiment if closure device 151 is located slightly laterally from the corner. However, the closure mechanism may also be located longitudinally on the package in other locations besides the preferred embodiment. Referring now to FIG. 22, it will be seen that the closure device 151 is an easy open single ribbon closure device and includes a strip portion 160 having a male element 161 thereon and a strip portion 162 having a female element 163 thereon. The single ribbon closure device also includes an arcuate portion 164 having longitudinal perforations or laser score lines 165 extending the length of the closure device. Perforations may also be used instead of scoring. The arcuate portion is also transversely perforated or laser scored at longitudinally spaced location 166. Thus the perforated or laser scored arcuate portion 164 functions as a segmented tear away strip which may be-incrementally removed. This arcuate portion also functions as a tamper evident element. It is not required to segment the tear strip, but instead tear the entire strip free of the closure to expose the entire access opening.

It will be noted that the apex of bag corner 159 is notched or cutaway at 166 as best seen in FIG. 22. It will also be noted that embodiment of the bag 150 has three layers including an outer layer 167, and intermediate layer 168 and an inner layer 169. It is pointed out that the bag 150 may have two or more paper layers or a combination of paper and poly. The strips 160, 162 of the zipper are positioned respectively between the outer layer 167 and the intermediate layer 168. The notch for the closure device removes the apices of all three layers. The closure device 151 projects exteriorly of the bag 150. The bag 150 is also provided with a tamper evident strip 170 which is secured to the inner layer 169. The tamper evident strip is firmly glued or otherwise attached at one side but is attached with tamper evident sealant at the other side permitting the strip to be torn away when the bag is opened. The tamper evident element may perforated to facilitate tearing to gain access to the contents.

Figure 23:
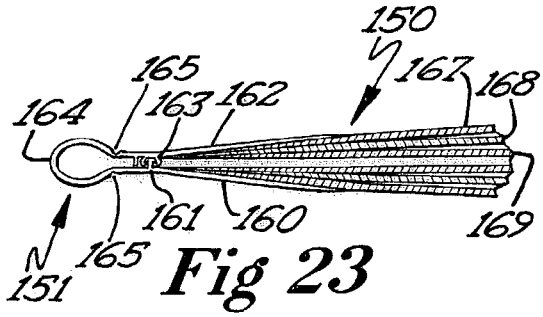
FIG. 23 is a cross-sectional view similar to FIG. 22 but illustrating a modification of the attachment of the closure device for a multi-layer paper bag.

Referring now to FIG. 23, it will be seen that a different embodiment for the attachment of the closure device 151 is there shown. The strip portion 160, 162 of the single ribbon closure device 151 are attached to the outer surface of the outer layer 167 thereby positioning the closure externally of the bag. The corner of the bag is slit longitudinally to define the access opening. The closure device 151 is identical to that of the embodiment of FIGS. 21-22.

Figure 24:
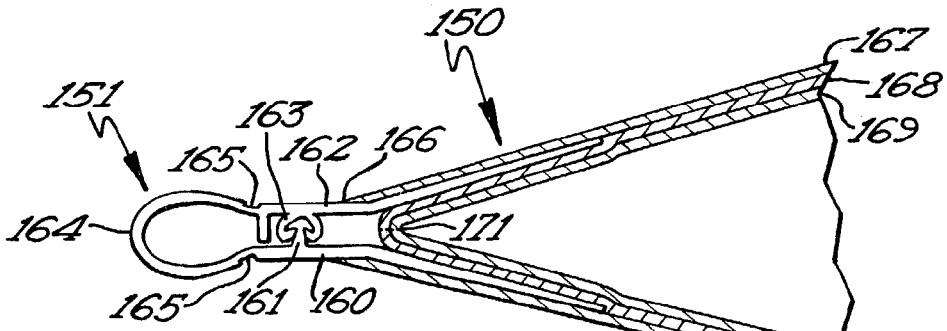
FIG. 24 is a cross-sectional similar to FIG. 22 illustrating another modification in the mounting of the closure device.

Referring now to FIG. 24, it will be seen that another modification of the access opening is there shown. The closure device is identical to that shown in FIG. 22 and includes strip portions 160, 162, male and female closure elements 161, 163, and an arcuate portion 164 longitudinally and transversely scored. However, it will be seen that the outer layer 167 is notched while the intermediate layer 168 and inner layer 169 are longitudinally perforated at 171. Access to the interior of the bag and contents therein is obtained when the closure device is opened and the perforated apices are broken in he conventional manner. The strips 160, 162 are positioned between outer layer 167 and the intermediate layer 168. By perforating the intermediate and inner layers rather than notching these layers as in FIG. 22, the perforated intermediate and inner layers function as a tamper evident element.

It will be noted that a slider closure device and a dual ribbon zipper strip could be utilized on bag 150.

It will be noted that a tamper evident strip could be added to the package between the layers to add additional strength. The tamper evident strip would be perforated to permit the strip to be broken or punctured by the consumer to gain access to the contents of the package.

It will be noted that a internal tear strip could be applied that would allow the consumer to first open the zipper and then pull the internal tear strip which would tear and strip from the internal layer thus allowing access to the contents of the package. This strip may be constructed of plastic, paper or string.

It is pointed out that the location of the closure device in the paper bag 150 imparts the same advantages including the elimination of channel leakers and the reduction of headspace as the advantages of the plastic bags. The bag disclosed in FIGS. 21-24 is ideally suited as pet food container since pet food producers and distributors have desired to have a package with a closure device. The location of the closure device for multi layer paper bags used as a pet food container enables consumers to scoop the contents from the container as well as pour the contents there from.

Referring now to FIG. 25, a different embodiment of bag 180 is there shown. The bag 180 is formed of a co-extruded poly or poly laminated, and includes opposed side panels 181, opposed end-panels 182, gussets 183 in the end panels, a sealed upper end 184 and a sealed lower end 185. The bag 180, when filled, has a substantially flat top 186, a flat bottom 187 and four longitudinal corners 188. In the embodiment shown, a longitudinally oriented access opening 188 is formed in one of the corners and is closed by an easy open slider closure device 189. The slider device is a commercially available closure and includes a male closure strip 190, a mating female strip 191 and an actuating tab 192. The male and female strips are secured to the adjacent corner portions of the bag and may be positioned either externally or internally of the bag. Moving the tab 192 in opposite directions selectively opens and closes the access opening in the manner of any conventional zipper. It will be noted that the closure device 189 is located at a corner 193 and extends longitudinally of the bag but terminates in spaced relation to the sealed ends of the bag. Further, the closure device preferred location is at corner 193. It will be noted that the closure device could be located at any location longitudinally of the package. While the use of an easy open closure device functions well in the fin of a zip-fin bag (FIGS. 1-6), the closure device and its longitudinal location at the corner of a non-fin bag works equally as well. A press to close could also be used in the form of a single or duel ribbon closure.

Thus the non-fin plastic bag 180 of FIG. 25 has all of the advantages inherent in the embodiments of the bag and closure of FIGS. 1-6. It is again pointed out that the orientation of the closure longitudinally of the bag in the embodiment of FIG. 25 eliminates channel leakers and reduces the headspace required in prior art conventional bags. The location of closure at the intersection of two planes as well as the radius configuration around the top provides the natural opening response when the closure is opened. The bag illustrated in FIG. 16-20 as pointed out may also be formed without fins.

Figure 26:
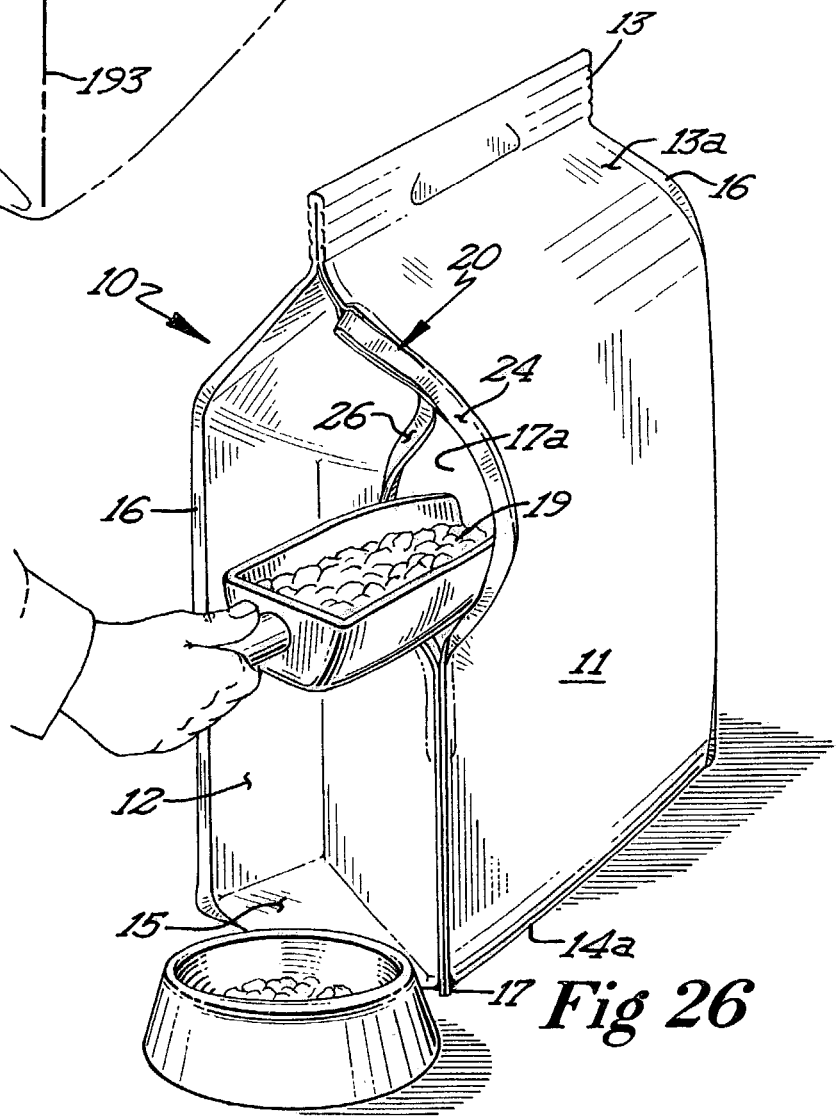
FIG. 26 is a perspective view of the embodiment of the bag of FIG. 1 with the closure device partially open illustrating the use of a scoop to remove contents thereof.

Referring now to FIG. 26, the removal of the contents of the bag with a scoop is there shown. The bag depicted in FIG. 26 is the embodiment of the bag shown in FIG. 1. The access opening 17*a* is illustrated in its naturally open condition permitting access and removal of the bag's contents with a scoop. Many of the previously described embodiments have shown stand-up bags having the longitudinal orientation of the access opening and closure device. When the longitudinally oriented closure is opened (FIG. 26) in these stand up bags, then a user may remove the bag's contents with a scoop, or, alternatively, the contents may be poured from the bag.

The bag disclosed in the embodiments of FIGS. 1-26 may be pre-made bags or may be made on-line with vertical and horizontal form fill seal equipment from a pre-applied zip fin roll or box fan folded. The longitudinal location of the access opening and easy open closure allows the producer to seal much closer to the product since additional headspace is not required for a transverse type easy-open re-close device. This reduction in headspace improves package appearance by creating a tighter filled package, which in turn reduces package size then leads to better looking pallets of bags since there is reduced overhang and less damage to packages in transit.

The longitudinal location of the closure device allows premade bags to be produced with the easy open re-close device pre applied. This arrangement also enables the producer to fill the bag conventionally through the top of bag without interference with the easy open re-close device. By spacing the easy open re-close closure device from the ends of the bag, interference with the sealing of the ends of the package are eliminated and thereby reduces the number of bags rejected because of channel leakers resulting from interference with the closure device.

The longitudinal location of the closure device and access opening on the package, internal to a corner fin seal of a gusseted bag creates a natural pour spout and a scoopable opening for the consumer. By locating the access opening and closure device so that it curves around the top of the package, a natural opening (access opening) is created when the closure device is opened to allow access to the contents of the package.

The closure device may also be provided with segmented or incrementally laser scored tear strip (to access the closure device) or perforated so that consumers may simply tear off more of the tear strip to gain better access to the contents of the package as the contents are removed. The package having the uniquely positioned closure device is also provided with a tamper evident element internally of the package extending the length of the closure device and removable by a consumer for accessing the contents of the package. The tamper evident element would also serve to prevent the press of the contents of the bag from forcing open the closure device from the inside of the package. The force exerted on the tamper evident strip is the force generated by the mass of the content of package acting on the tamper evident strip. The tamper evident strip element would use shear forces (stronger) to hold the strip in place from the product side and peel type forces (weaker) to remove the strip from the consumer side of the bag. Peel seal tamper evident elements will be used on smaller packages.

The single ribbon strip closure has the tear away cover strip which also functions as a tamper evident feature. The zip-fin closure works very well with laminate films such as those used in potato chip packages.

The longitudinal position of the closure device allows the closure to be a zip-fin closure. The longitudinal location also permits the single ribbon type closure to be used. Other advantages of the longitudinal position of the easy open closure device is the use of an integrity strip and results in less headspace. The longitudinal position of the closure also enables consumers to scoop or pour the contents from a bag. Finally, the longitudinal location eliminates channel leakers and thereby results in less rejects.

Figures 27, 28, 29:
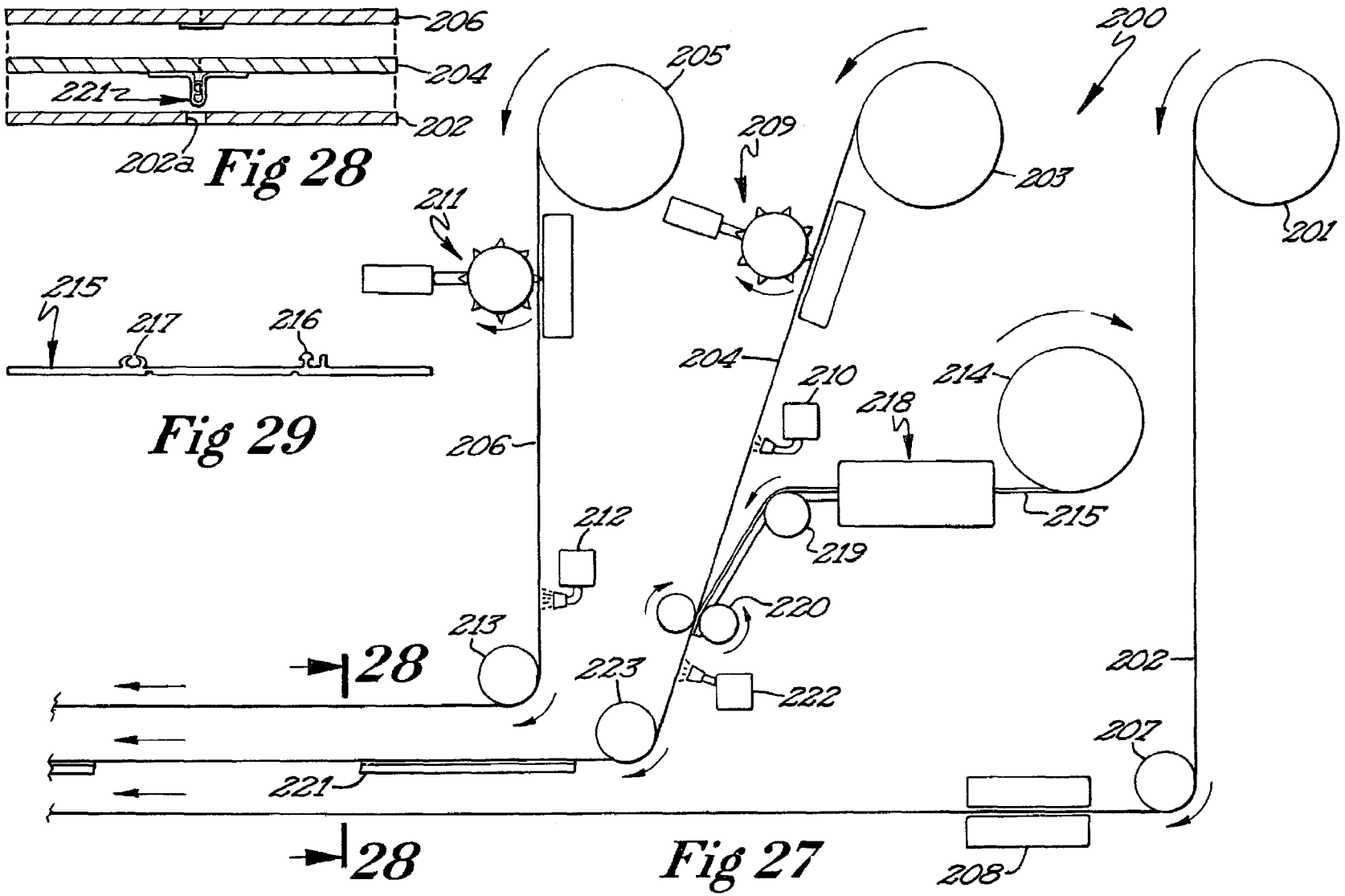
FIG. 27 is a diagrammatic elevational view of an apparatus for forming a multi layer paper material and applying an easy open closure thereto as a preliminary process in forming a paper bag.
FIG. 28 is a cross-sectional taken approximately along line 28-28 and looking in the direction of the arrows.
FIG. 29 is an end elevational view of a single ribbon closure strip.

Referring now to FIGS. 27-29, it will be seen that an apparatus for carrying out the process steps of forming multi layer paper material and applying a closure device thereto is diagrammatically illustrated. The apparatus 200 includes a plurality of paper rolls providing a source of elongate paper sheets which move in a predetermined path of travel during the process.

An elongate sheet 202 of paper is continuously unwound from paper roll 201 and is moved in a predetermined path of travel past a guide roll 207. An elongate sheet 204 of paper is continuously unwound from a roll 203 and continuously moved in a predetermined path of travel. An elongate sheet 206 is continuously unwound from a paper roll 205 and is moved in a predetermined path of travel.

It will be noted that during the travel of sheet 202, it is move past a reciprocating slitter mechanism 208 which makes slits intermittently in the sheet. The slits are preferably made at a location on the sheet 202 which will extend longitudinally of the paper bag 150 shown in FIG. 21. However, the slit may be oriented in any direction and at any location as long as the slit for the closure is spaced from the sealed ends of the formed bag. It will be noted that the slitter mechanism 208 is located downstream of guide roller 207.

The sheet 204 is first moved past a reciprocating perforating mechanism 208 which intermittently perforates the sheet 204. Thereafter the sheet 204 is moved past an adhesive applicator 210 which applies an adhesive to one surface 204*a* of the sheet.

The sheet 206 is first moved past a reciprocating perforating mechanism 211 which intermittently perforates the sheet 206. It is pointed out that the perforations made in sheets 204,206 are longitudinally of the sheet. The perforation would ultimately correspond to the perforations 171 in the inner and intermediate layers 169, 168 of FIG. 24. Thereafter the sheet 206 is moved past an adhesive applicator 212 where adhesive is applied to one surface 206*a* of sheet 206. It will be noted that the adhesive applicator is upstream of a guide roller 213.

An elongate sheet of closure material 215 is continuously unwound from a roll 214 of closure material and is moved in a predetermined path of travel. Referring now to FIG. 29, it will be seen that the sheet 215 has a male closure element 216 and a female closure element 217 on one surface of the sheet. The elongate sheet 215 is moved past a closure forming mechanism 218 where the sheet 215 is folded and male and female elements are mated in engaging relations. The male and female elements are weakly welded together in mating relation (see FIG. 24) in the mechanism 218 but may be readily pulled apart.

The sheet 215 is passed from the forming and welding mechanism 218 and passes over a guide 219 and between a pair of pinch rolls 220 where the folded closure material is brought into intimate contact with the adhesive coated surface 204*a* of sheet 204 to bond therewith. A cutting means in the mechanism 218 intermittently cuts the folded closure material into closure sections 221 bonded to the sheet 204. Downstream of the pinch rolls 220, an adhesive applicator 222 coats that portion of the surface 204*a* located around the closure section 221. Thereafter the sheet 204 is moved past guide roller 223.

It will be noted that the sheets 202, 204 and 206 are disposed in parallel relation as these sheets move past the respective guide rollers 207, 213 and 223. The sheets will be progressively moved in converging relation as the sheets move downstream. The sheets will move into contacting relation and bond to each other to form the multi layer material having the closure section 221 secured thereto.

The folded closure will project through the slit 202*a* in the sheet 200 (see FIG. 28) and the closure section will be secured between outer and intermediate layers in the manner of FIG. 24. The closure will have the laser scored tear away strip (arcuate portion of the closure in FIG. 28) and the flanges of the closure will be bonded to the surface 204*a*of sheet 204.

After the sheets 202, 204, and 206 are bonded, the multi layer paper material will be directed to an in-line tube machine similar to the machine manufactured Wind Moeller and Hoelscher.

Referring now to FIG. 30-39 it will be seen that an apparatus 250 is shown for carrying out the process for forming a plastic bag having a longitudinally oriented closure device. The apparatus includes a roll 251 of plastic film sheet 252 which is continuously unwound from the roll and moved in a predetermined path of travel. The film sheet 25 is provided with oval shaped laser scores 255 on the bottom surface of film sheet. These elongate oval shape scores extend longitudinally of film and in the direction of travel.

The oval score areas 255 actually constitute the tear away cover of the closure device. A strip or ribbon 257 of closure material is continuously unwound from a roll 256 of closure material and moved in predetermined path of travel. In this path of travel, the strip 257 is moved through a sealing and cutting mechanism 249. The strip 257 is moved into contacting relation with the upper surface 253 of the film sheet 252 and is sealed thereto by a suitable heating element and roller. A cutter means (not shown) in mechanism 249 cuts the strip 257 to form closure sections 257*a* sealed to the film sheet. Each closure section 257*a* is sealed to the upper surface 253 of the film sheet in overlying relation with respect to an oval shaped score area.

Figures 30, 31, 32, 33, 34:
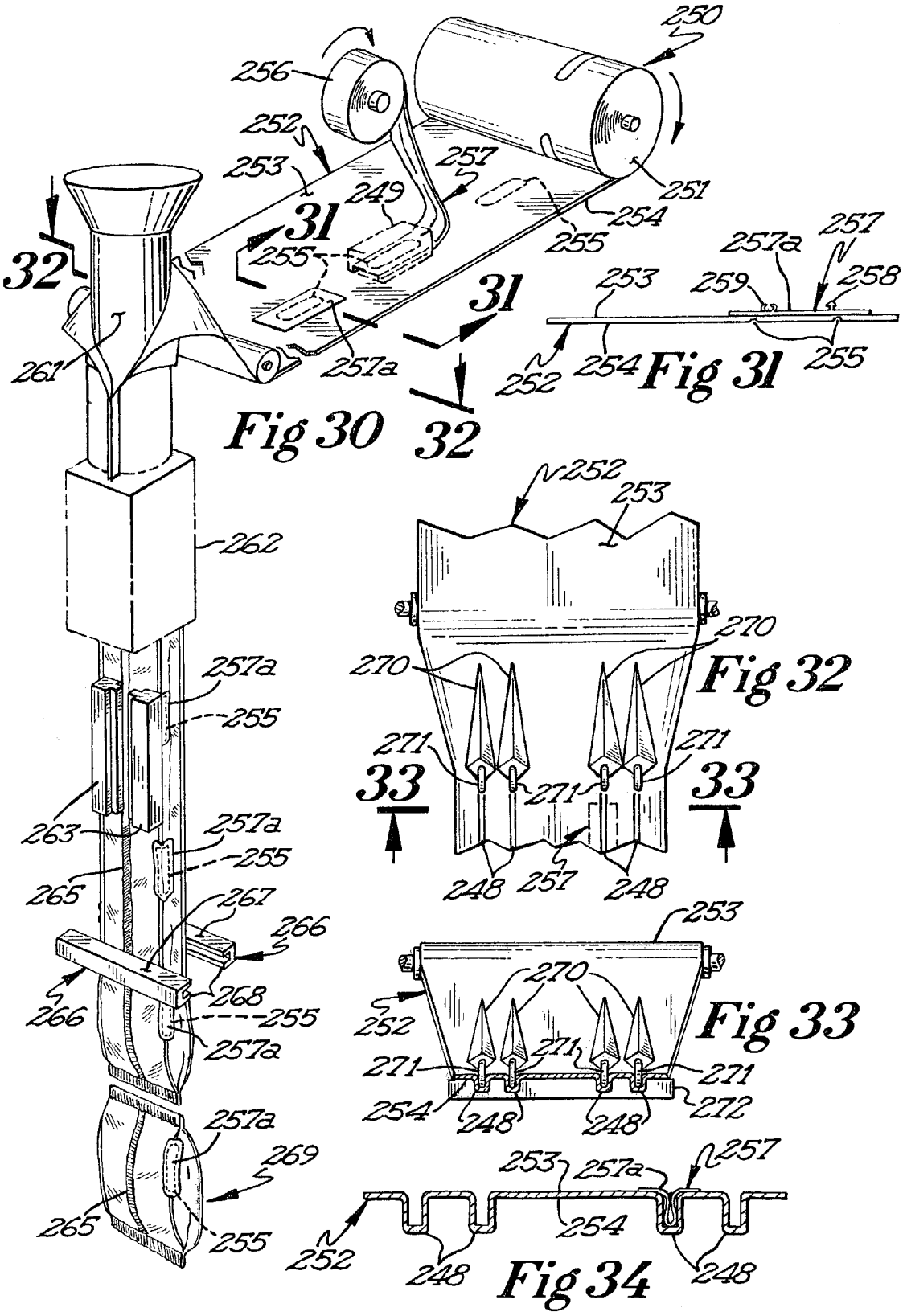
FIG. 30 is a diagrammatic perspective view of apparatus illustrating the process of forming a fin type plastic bag and applying an easy open closure thereto.
FIG. 31 is a cross-sectional view taken along line 31-31 of FIG. 30 and looking in the direction of the arrows.
FIG. 32 is a cross-sectional view taken along line 32-32 of FIG. 30 and looking in the direction of the arrows.
FIG. 33 is a cross-sectional view of the apparatus depicted generally in FIG. 30 taken along line 33-33 of FIG. 32 and looking in the direction of the arrows.
FIG. 34 is a cross-sectional of the film sheet showing the configuration of the film sheet as the fins are being formed and illustrating a closure device inserted into a fin.

The strip 257 of closure material has the male closure element 258 and the female closure element 259 on one surface thereof. When closure sections 257*a* are bonded to the film sheet 252, the male and female elements project upwardly as best seen in FIG. 31. The film sheet 252 is then moved into contacting relation with the fin forming means as best seen in FIGS. 32-36. This forming means includes forming plows 270 and pressure rollers 271 which press the film into formers 272. FIG. 34 illustrates the configuration of the fin portions 248 before sealing. A closure device 257*a* is positioned within one of the fins 248.

Figure 35:
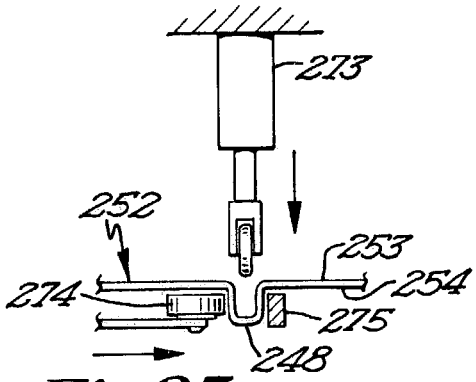
FIG. 35 is a diagrammatic elevational view with parts thereof broken away illustrating the formation of a fin.
Figure 36:
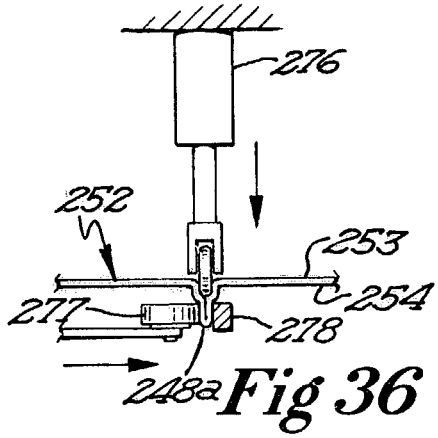
FIG. 36 is a diagrammatic elevational view of the apparatus depicted generally in FIG. 30 with parts thereof broken away and illustrating the formation of a fin sealed at its tip.

The partially formed fins are then engaged by a reciprocating wheel 273 to shape the fins prior to engagement of the fins 248 by reciprocating rollers 274 which move the shaped fin against a sealing bar 175 as best in FIG. 35. FIG. 36 illustrates the formation of a sealed tip fin 248*a*. The reciprocating wheel 276 cooperates with the reciprocating roller 277 and sealing bar 266 to seal only the tip of the fin. The fins sealed by the reciprocating wheel 273, roller 274 and sealing bar 275 of FIG. 35 are sealed more completely.

Figure 37:
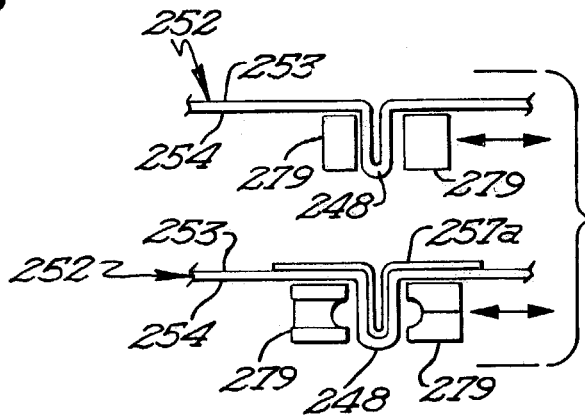
FIG. 37 is a diagrammatic elevational view of certain portions of the apparatus depicted generally in FIG. 30 with parts thereof broken away and sequentially illustrating the formation of a fin and the application of a closure device thereto.

Referring now to FIG. 37, the sequence of forming a fin and applying a closure device thereto is thereshown. The upper illustration shows the fin being shaped while the lower illustration shows the insertion of the closure device 257*a* prior to sealing the fin 248. The sealing bars 279 are then moved into sealing relation with the fin and closure device 257*a*.

Figure 38:
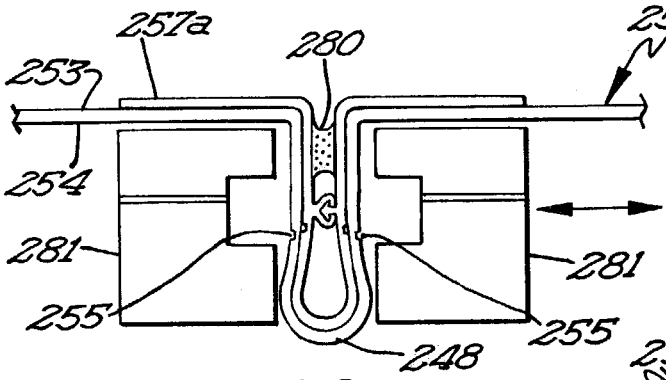
FIG. 38 is a diagrammatic elevational view of certain portions of the apparatus shown in FIG. 30 with parts thereof broken away illustrating the formation of a closure device and a peel tamper element applied to a fin.

Referring now to FIG. 38, it will be seen that the steps for applying a closure device 257*a* and a peel seal tamper element 280 to a fin are shown. Sealing bars 281 are moved into contacting relation with the flanges of the fin. The sealing bars engage the fin to seal the scored arcuate portion of the fin to the arcuate portion of the zipper or closure strip. The arcuate portions of the fin and closure strip are sealed together to form the tear away strip. The tamper seal material is heated sufficiently to seal the tamper evident to the fin but with a low weld effect which allows the tamper evident to be readily peeled away.

Figure 39:
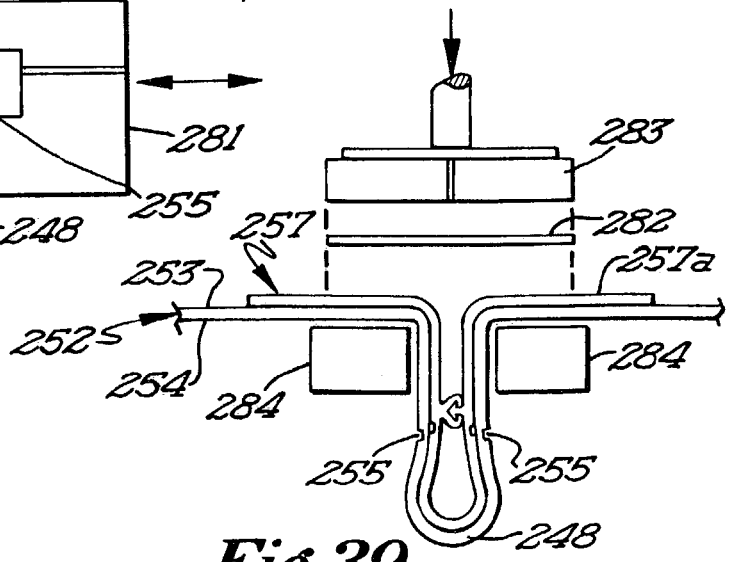
FIG. 39 is a diagrammatic elevation view of a portion of a modified apparatus with parts thereof broken away and illustrating the formation of a closure device and tamper evident strip applied to a fin.

Referring now to FIG. 39, the steps of applying and securing a tamper evident strip 282 to a bag or film sheet is thereshow. The closure device 257*a* is applied to a fin 248 and a tamper evident element 282 is positioned against the flange portion of the closure or zipper ribbon secured to the film or formed bag. A reciprocating sealing bar 283 is pressed against the film and supporting bars 284 to seal the tamper evident strip to the film 252. It is pointed out that the steps described hereinabove with respect to FIG. 32-39 will occur as the film sheet is moving in its path of travel.

Figure 40:
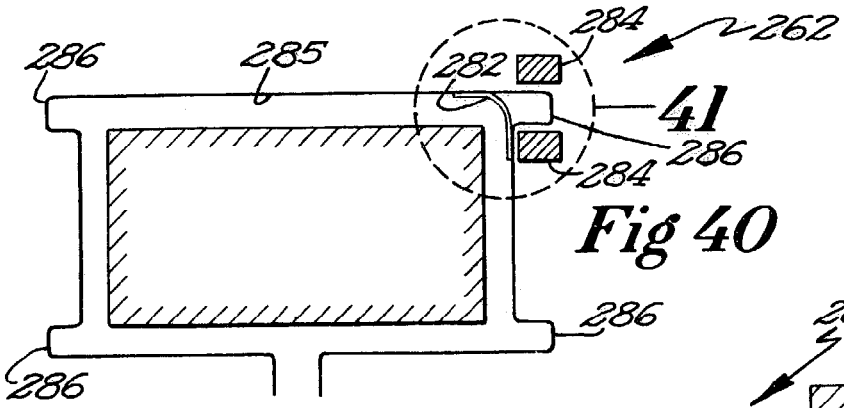
FIG. 40 is a diagrammatic cross-sectional view of the zipper guide device comprising a component of FIG. 30.
Figure 41:
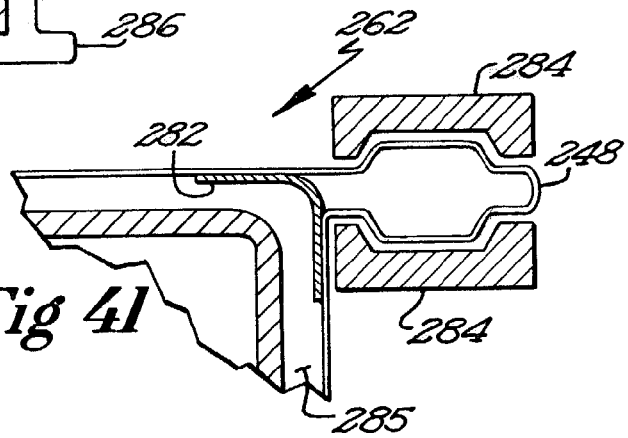
FIG. 41 is an enlarged diagrammatic cross-sectional view of that portion of the zipper guide illustrated in the phantom line circle of FIG. 40.

Referring again to FIG. 30, the sheet film 252 with the formed fins then engages a guide roll 260 during movement of the film sheet in its path of travel. The film is moved against a forming shoe 261 and formed into a generally tubular shape. The film sheet 252 is then moved through a zipper or closure device guide 262. The pathway or guide way 285 through zipper guide 262 is illustrated in FIG. 40. It will be seen that the corner portions project outwardly to accommodate the formed fins 248 and closure device or zippers. FIG. 41 illustrates the fin and closure in these corner projections with a tamper evident strip 282 applied to the film sheet.

The film sheet continues its movement along the shaping shoe 261 and the edges of the film sheet are engage vertically disposed sealing bars 265 to form the back seam 265 of the bag. Thereafter, the film sheet is engaged by horizontal sealing bars which simultaneously form the sealed upper at one bag and the sealed lower end of the adjacent bag. In this regard, the sealing bars have upper sealing elements 267 and lower sealing elements 268. The formed bag 269 has four corner fins and a closure device 257*a* in one of the corner fins.

The closure device 257*a* extends longitudinally of the bag but is spaced from the sealed upper and lower ends. In some instances the film with the formed fins and closure devices thereon will be sold as film rolls or from cartons. It is desirable to have the fins 248 of the film to have a flattened uniform configuration such as that shown in FIG. 43.

Figure 42:
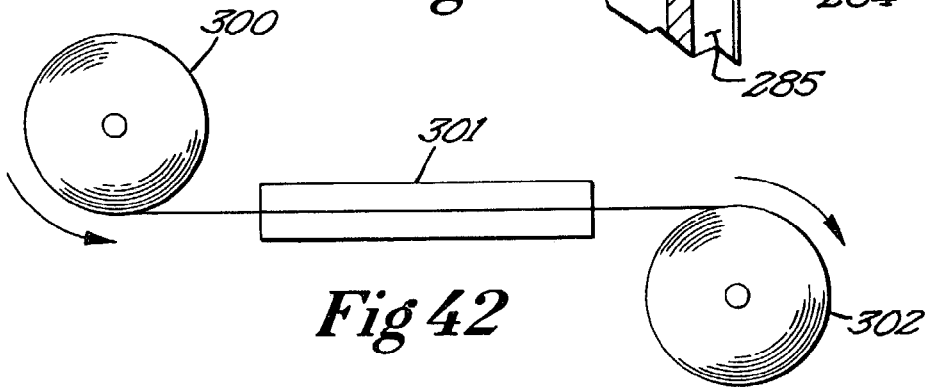
FIG. 42 is a diagrammatic elevational view of an apparatus for folding pre-formed zip fins into the configuration of FIG. 43.
Figure 43:
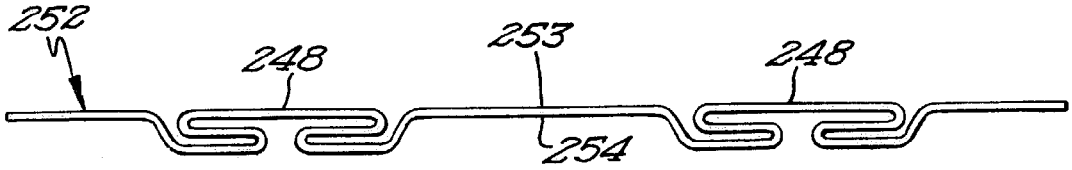
FIG. 43 is a diagrammatic elevational view of the folded configuration of the film having pre-formed fins and folded by the apparatus of FIG. 42.
Figure 44:
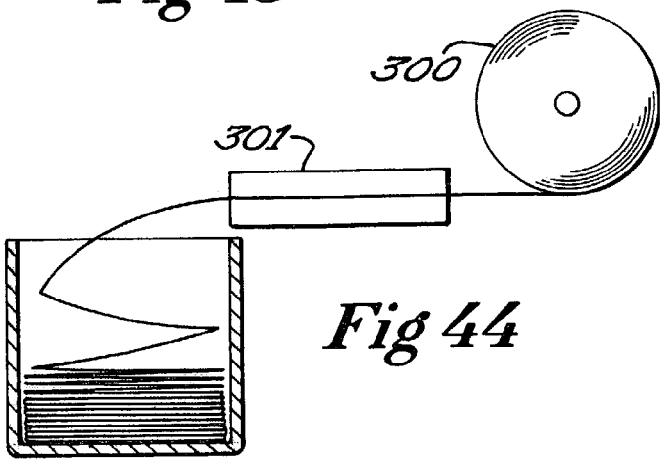
FIG. 44 is a diagrammatic elevational view of a roll of film having preformed fins passing through a zip-fin application device for folding the film and thereafter moving the folded film into a carton.

The roll 300 of film with non-uniformly arranged fins 248 will be continuously unwound and passed through a zip-fin application device 301 as shown in FIG. 42 where the fins 248 are folded over into the shape shown in FIG. 43. The rolls or cartons with the fins arranged in this manner have better marketing appearance. FIG. 44 shows a roll of film with non-folded fins being passed through a zip-fin application device. The film with the uniformly folded fins is discharged in fan shaped configuration into a carton.

What is claimed is:

1. A bag having a width dimension, a transverse dimension, a vertical longitudinal dimension, opposed sealed ends and panel means extending between the sealed ends, adjacent panels means being folded over to form closed fins extending longitudinally of the bag, each fin having opposed inner surfaces and outer surfaces, and having an arcuate outer portion, the arcuate outer portion of one fin being formed to enable the arcuate portion to be readily removed from the fin to define an elongate access opening extending longitudinally of the bag, a re-closable device positioned within said one fin including opposed mating male and female closure elements, each being secured to one of the inner surfaces of said fin and being readily engagable and disengagable with respect to each other for selectively opening and closing the elongate access opening, said closure extending longitudinally of the bag but spaced from the sealed ends.

2. The bag as defined in claim 1 wherein the re-closable closure device is an easy open slide type closure.

3. The bag as defined in claim 1 wherein the bag is formed of a polymer.

4. The bag as defined in claim 1 wherein the bag is formed of a multi layer paper/poly material.

5. The bag as defined in claim 1 wherein the bag is provided with a removable tamper evident element secured to the bag in obstructing relation to the access opening, said tamper evident element being spaced from the closure device.

6. The bag as defined in claim 1 wherein the closure device is a press to close closure device.

7. The bag as defined in claim 1 wherein the closure device is a slider having mating closure elements and a slidable tab for selectively opening and closing the closure.

8. A bag, when filled with a product, having opposed pairs of panels and having sealed ends, the bag having a longitudinal dimension extending vertically of the bag, adjacent panels of said bag being folded over to form closed corner fins extending longitudinally of the bag, each fin having opposed inner surfaces and outer surfaces and an outer arcuate portion, the outer surfaces of the arcuate outer portion of one fin being longitudinally scored to enable the arcuate outer portion to be readily removed from the fin to define an access opening, an elongate re-closable easy open closure device positioned within said one fin including opposed mating male and female closure elements, each being secured to one of the inner surfaces of said fin and being readily engagable and disengagable with respect to each other for selectively opening and closing said access opening in the bag and said access opening extending longitudinally of the bag said closure device being spaced from the sealed ends of the bag.

9. The bag as defined in claim 8 wherein the bag has a generally parellelepiped configuration having four corner areas defined by the closed corner fins between adjacent panels, said bag having a substantially flat top and substantially flat bottom, said closure device located at one of said corner areas and extending longitudinally of the flat top.

10. The bag as defined in claim 9 wherein said closure is a press to close closure.

11. The bag as defined in claim 9 wherein said bag is formed of a polymer.

12. The bag as defined in claim 9 wherein said bag is formed of a multi layer paper material.

13. The bag as defined in claim 9 and a removable tamper evident element secured to the bag in obstructing relation to the access opening, said tamper evident element spaced inwardly from the closure device and presenting an outwardly convex configuration and shielding the closure device from impact loads.

14. A bag, which when filled, having opposed pairs of panels, sealed ends, a substantially flat top, a substantially flat bottom, and having a generally parallelepiped configuration, the bag having portions of adjacent panels sealed together to form closed corner fins projecting outwardly of corners of the bag and extending longitudinally of the bag, said fins having opposed inner surfaces and outer surfaces and one of said fins having a tear away arcuate outer portion to define an access opening, an easy open closure device positioned within said one fin for selectively closing and opening the access opening in the bag, including elongate mating male and female closure elements, each being secured to one of the inner surfaces of the associated fin, said mating male and female closure elements of said closure device extending longitudinally of the bag in a vertical direction and around a corner of the top of the bag but spaced from the sealed ends of the bag.

15. The bag as defined in claim 14 wherein said bag is formed of a polymer.

16. The bag as defined in claim 14 wherein said closure is a press to close closure device.

17. The bag as defined in claim 15 wherein said fin having the closure device therein includes a pair of flanges having an arcuate outer portion integrally formed therewith, the flanges of said fin having elongate longitudinal score lines extending throughout the length of the flanges adjacent said arcuate portion, said arcuate portion having longitudinal spaced apart laser score lines intersecting the longitudinal score lines to defined a segmented tear away strip which may be incrementally removed to expose a portion of the closure device.

18. The bag as defined in claim 15 wherein said bag is provided with an elongate removable tamper evident strip secured to the inner surface of the bag in obstructing relation to the access opening, said tamper evident strip having an edge hard welded to the bag and having another edge secured to the bag by an adhesive said tamper evident strip being spaced from the closure device and presenting an outwardly convex configuration.

* * * * *